US010687563B2

(12) United States Patent
Plant et al.

(10) Patent No.: US 10,687,563 B2
(45) Date of Patent: Jun. 23, 2020

(54) GAMER HOODIE

(71) Applicant: HBI Branded Apparel Enterprises, LLC, Winton Salem, NC (US)

(72) Inventors: Andrew M. Plant, Winston-Salem, NC (US); Marlon J. Harris, Winston Salem, NC (US)

(73) Assignee: HBI Branded Apparel Enterprises, LLC, Winston, Salem, NC (US)

( * ) Notice: Subject to any disclaimer, the term of this patent is extended or adjusted under 35 U.S.C. 154(b) by 0 days.

(21) Appl. No.: 16/412,153

(22) Filed: May 14, 2019

(65) Prior Publication Data

US 2019/0380397 A1 Dec. 19, 2019

Related U.S. Application Data

(63) Continuation-in-part of application No. 16/007,583, filed on Jun. 13, 2018.

(51) Int. Cl.
*A41D 27/20* (2006.01)
*A41D 1/00* (2018.01)
(Continued)

(52) U.S. Cl.
CPC ..... *A41D 1/002* (2013.01); *A41D 3/005* (2013.01); *A41D 27/205* (2013.01);
(Continued)

(58) Field of Classification Search
CPC . A61B 5/6804; A61B 5/0022; A61B 5/04085; A61B 5/7455; A61B 5/7475;
(Continued)

(56) References Cited

U.S. PATENT DOCUMENTS 796,711 A 8/1905 Ferguson
2,079,220 A 5/1937 Mahoney
(Continued)

FOREIGN PATENT DOCUMENTS

CN 203194581 9/2013
DE 102011122751 7/2013
(Continued)

OTHER PUBLICATIONS

"Lateral." The Merriam-Webster.com Dictionary, Merriam-Webster Inc., https://www.merriam-webster.com/dictionary/lateral. Accessed Dec. 18, 2019. (Year: 2019).*
(Continued)

*Primary Examiner* — Robert H Muromoto, Jr.
(74) *Attorney, Agent, or Firm* — Fish & Richardson P.C.

(57) ABSTRACT

An upper torso garment has a torso section extending from a waist region to a neck region, the torso section including a front region and a back region, where the front region is positioned adjacent a chest of a wearer of the garment and the back region is positioned adjacent a back of the wearer. The torso section includes a left torso region and a right torso region, where the left torso region is positioned on a lateral left side of the torso section and the right torso region is positioned on a lateral right side of the torso section. The garment includes quick-draw pockets on the front region, back region, or both, proximate to the waist region. The quick-draw pockets can be reversed pockets, where the opening is oriented at least partly toward an opposite lateral side of the respective front region or back region.

28 Claims, 17 Drawing Sheets

(51) Int. Cl.
*A41D 3/00* (2006.01)
*A41D 1/04* (2006.01)

(52) U.S. Cl.
CPC .... *A41D 2200/20* (2013.01); *A41D 2300/322* (2013.01); *A41D 2600/10* (2013.01)

(58) Field of Classification Search
CPC ... A61B 2562/12; A61B 5/024; A61B 5/4806; A61B 5/0002; A61B 5/6802; A61B 5/04; A61B 2560/04; A61B 2562/0209; A61B 5/0024; A61B 5/0478; A61B 5/486; A61B 5/74; H05K 1/0283; H05K 1/038; H05K 1/092; H05K 1/095; H05K 3/361; H05K 1/0393; H05K 1/16; H05K 2201/0281; A41D 13/1281; A41D 1/002; A41D 27/00; A41D 13/1236; A41D 27/205; A41D 13/0012; A41D 13/0017; A41D 1/22; A41D 2400/46; A41D 2600/10; A41D 27/20; A41D 27/208; A41D 1/005
See application file for complete search history.

(56) References Cited

U.S. PATENT DOCUMENTS 2,558,533 A 6/1951 Bell
D250,226 S 11/1978 Shaw
4,689,831 A 9/1987 Greenberger
D355,752 S 2/1995 Abbott
5,400,440 A 3/1995 Clifford
5,718,000 A 2/1998 Ost et al.
5,784,719 A 7/1998 Robinson
5,813,051 A 9/1998 Counter
5,819,728 A 10/1998 Ritchie
5,845,334 A 12/1998 Marcolini
D404,539 S 1/1999 Glasser
D411,576 S 6/1999 Hames
5,950,240 A 9/1999 Carpenter
5,987,644 A 11/1999 Mengato
D439,029 S 3/2001 Goldman
RE38,497 E 4/2004 Falk et al.
7,318,239 B2 1/2008 Wood
7,519,192 B1 4/2009 Laycock
7,761,930 B2 7/2010 Krause
D636,973 S 5/2011 Smith
7,945,971 B2 5/2011 Garza
7,992,225 B2 8/2011 Demus
D692,212 S 10/2013 Coward
8,549,670 B2 10/2013 Demus
8,613,112 B2 12/2013 Santucci
8,677,515 B2 3/2014 Ishihara
D711,627 S 8/2014 Badr
8,910,315 B1 12/2014 Stephens
8,945,328 B2 * 2/2015 Longinotti-Buitoni ..... A61B 5/0002 156/234
9,271,533 B2 3/2016 Kochling
9,282,893 B2 * 3/2016 Longinotti-Buitoni ..... A61B 5/6804
9,456,639 B2 10/2016 Aylward
9,504,283 B2 11/2016 Gheneva
9,743,743 B2 * 8/2017 Grote ..... A45F 5/00
9,817,440 B2 * 11/2017 Longinotti-Buitoni ..... A61B 5/6804
9,986,771 B2 * 6/2018 Longinotti-Buitoni ..... A61B 5/0002
10,045,439 B2 * 8/2018 Longinotti-Buitoni ..... A61B 5/6804
10,143,249 B2 * 12/2018 West ..... A41D 27/02
10,194,705 B2 2/2019 Amrhein
10,463,085 B2 * 11/2019 McGargill ..... A41D 1/084
10,529,257 B1 1/2020 Peelgrane
2002/0088046 A1 7/2002 Fidler
2003/0144039 A1 * 7/2003 Lin ..... A41D 1/005 455/575.2
2004/0221360 A1 11/2004 Wood
2008/0184459 A1 8/2008 Barnes
2009/0262967 A1 10/2009 Bryan
2010/0071110 A1 3/2010 Stevens
2010/0329499 A1 12/2010 Wolfe
2011/0119800 A1 5/2011 Garrido
2011/0185469 A1 8/2011 Santuccio et al.
2011/0185471 A1 8/2011 Buczkowski
2012/0060261 A1 3/2012 Raviv
2012/0185999 A1 * 7/2012 Raviv ..... A41D 27/205 2/247
2014/0070957 A1 * 3/2014 Longinotti-Buitoni ..... A61B 5/6804 340/870.01
2014/0231277 A1 8/2014 Ponski
2014/0318699 A1 * 10/2014 Longinotti-Buitoni ..... A61B 5/0002 156/247
2015/0040282 A1 * 2/2015 Longinotti-Buitoni ..... A61B 5/6804 2/69
2015/0143601 A1 * 5/2015 Longinotti-Buitoni ..... A61B 5/0002 2/69
2015/0144673 A1 5/2015 Dahl et al.
2015/0189931 A1 7/2015 Elliott
2015/0296900 A1 10/2015 Huang
2016/0198781 A1 7/2016 Israel
2016/0200386 A1 7/2016 Jarmon
2016/0206017 A1 * 7/2016 Aylward ..... A41D 27/205
2017/0086569 A1 * 3/2017 Grote ..... A45F 5/00
2017/0196513 A1 * 7/2017 Longinotti-Buitoni ..... A61B 5/6804
2017/0318943 A1 * 11/2017 Grote ..... A45F 5/00
2018/0067516 A1 * 3/2018 Longinotti-Buitoni ..... A61B 5/6804
2018/0376586 A1 * 12/2018 Longinotti-Buitoni ..... A61B 5/0002
2019/0014842 A1 1/2019 Israel
2019/0132948 A1 * 5/2019 Longinotti-Buitoni ..... D06N 3/0063
2019/0380398 A1 12/2019 Plant

FOREIGN PATENT DOCUMENTS

DE 202015004885 8/2015
GB 2494142 3/2013
KR 20130005170 8/2013
TW 200711586 4/2007
WO WO2002087386 11/2002
WO WO2009150026 12/2009
WO WO2011119133 9/2011

OTHER PUBLICATIONS

"Proximal." The Merriam-Webster.com Dictionary, Merriam-Webster Inc., https://www.merriam-webster.com/dictionary/proximal. Accessed Dec. 18, 2019. (Year: 2019).*
No Author, "KontrolFreek® Launces Performance Gaming Wear TM" Atlanta, GA, Jan. 24, 2017, 2 pages.
International Invitation to Pay Additional Fees in International Application No. PCT/US2018/065162, dated Apr. 29, 2019, 21 pages.
International Search Report and Written Opinion in International Application No. PCT/US2018/065162, dated Aug. 8, 2019, 25 pages.
U.S. Appl. No. 16/007,583, filed Jun. 13, 2018, Plant.
International Search Report and Written Opinion in International Application No. PCT/US2019/036621, dated Dec. 20, 2019, 16 pages.

* cited by examiner

GAMER HOODIE

CROSS-REFERENCE TO RELATED APPLICATIONS

This application is a continuation-in-part of and claims the benefit of priority to U.S. application Ser. No. 16/007,583, titled "GAMER HOODIE" and filed on Jun. 13, 2018, the contents of which are hereby incorporated by reference.

TECHNICAL FIELD

This instant specification relates to a garment, and, more particularly to an upper torso garment having features for use in electronic gaming activities.

BACKGROUND

In recent years, garments designed as outerwear have been developed to provide more than just warmth and protection. Consumers value storage spaces and ease of access, regardless of whether the garment is used for outdoor activities, such as hiking or camping, or for more urban daily use.

Electronic devices, such as cell phones, media players, and smartphones are now common accessories that consumers carry and use constantly, regardless of the activity. Easy access to these electronic devices and being able to utilize the many features that these devices offer has become increasingly important for consumers. The ability to carry, use and operate such a device, e.g., navigate from one song to the next or one application to the next, is desirable.

Electronic gaming has increased in popularity. Simple "pong" type games that were once played in isolation or pairs at home have evolved into interconnected gaming environments. Enthusiasts have elevated the status of such activities from mere "games" to the level of competitive spectator sports, complete with live tournaments, teams, broadcasts, and sponsorships. And similar to the way that athletic competitors value their personal equipment and would never go into competition without it (e.g., their own shoes, custom golf clubs, specially tuned bicycles, rackets, bowling balls, baseball gloves), competitive gamers value the use of their own personal equipment as well (e.g., customized/specialized gaming controllers and/or keyboards, communications equipment, eyewear).

There are known garment designs that allow interconnectivity between multiple devices positioned in different pockets. The more common electronic devices used by consumers today, however, perform multiple functions, e.g., a single device is a cell phone, a web browser, and a media player, with features that several years ago would have required two or more devices to perform. A suitable garment design that allows electronic gaming enthusiasts to hold and enhance the use of personal electronic gaming equipment and the wires associated with the equipment has not heretofore been known.

SUMMARY

In general, this document describes a garment, and, more particularly to an upper torso garment having features for use in electronic gaming activities.

In some aspects, a hooded garment includes a torso section extending from a waist region to a neck region, wherein the torso section comprises a chest region and a back region, the back region comprising a vertical pocket having a pocket opening formed in an upper half of the back region and defining a space having a depth between the neck region and the waist region that is longer than a width between a left torso region and a right torso region, a hood extending upward from the neck region and having a front opening, a right sleeve extending from a right shoulder region of the right torso region and having a first wrist opening, and a left sleeve extending from a left shoulder region of the left torso region and having a second wrist opening.

Various embodiments can include some, all, or none of the following features. The torso section can include at least one of a front right pocket having a first opening in the right torso region proximal the waist region on the chest region, the first opening being at least partly oriented toward the left torso region across the chest region, and a front left pocket having a second opening in the left torso region proximal the waist region on the chest region, the second opening being at least partly oriented toward the right torso region across the chest region. The torso section includes at least one of a back right pocket having a first opening in the right torso region proximal the waist region on the back region, the first opening being at least partly oriented toward the left torso region across the back region, and a back left pocket having a second opening in the left torso region proximal the waist region on the back region, the second opening being at least partly oriented toward the right torso region across the back region. At least one of the right sleeve and the left sleeve can also include a channel having at least a first opening proximal the neck region and a second opening proximal at least one of an elbow region and the first wrist opening or the second wrist opening. The hooded garment can also include an electrical cord assembly comprising a plurality of electrically isolated conductors at least partly retained within the channel, the electrical cord assembly having a first end proximal the neck region and extending to a second end proximal at least one of the elbow region and the first wrist opening or the second wrist opening. At least one of the right sleeve and the left sleeve can also include a retainer configured to be affixed to an electronic game controller. At least one of the right sleeve and the left sleeve can also include an electronic device pocket proximal the first wrist opening or the second wrist opening and having a substantially transparent window configured to permit viewing of a display of an electronic device secured within the electronic device pocket. The hooded garment can include one or more affixment points configured to removably affix ornamental patches to the hooded garment. The vertical pocket can be configured to hold a first portion of a personal computer (PC) gaming keyboard in a vertical orientation, and a second portion of the keyboard visibly extends vertically through the pocket opening toward the neck region.

In certain aspects, a hooded garment includes a torso section extending from a waist region to a neck region, wherein the torso section has a chest region and a back region, a hood extending upward from the neck region and having a front opening, a right sleeve extending from a right shoulder region of a right torso region and having a first wrist opening, and a left sleeve extending from a left shoulder region of a left torso region and having a second wrist opening, wherein the torso section also includes at least one of a front right pocket having a first opening in the right torso region proximal the waist region on the chest region, the first opening being at least partly oriented toward the left torso region across the chest region, a front left pocket having a second opening in the left torso region proximal the waist region on the chest region, the second opening being at least partly oriented toward the right torso region across the chest region, a back right pocket having a third opening in the right torso region proximal the waist region on the back region, the third opening being at least partly oriented toward the left torso region across the back region, and a back left pocket having a fourth opening in the left torso region proximal the waist region on the back region, the fourth opening being at least partly oriented toward the right torso region across the back region.

Various embodiments can include some, all, or none of the following features. At least one of the right sleeve and the left sleeve can also include a channel having at least a first opening proximal the neck region and a second opening proximal at least one of an elbow region and the first wrist opening or the second wrist opening. The hooded garment can also include an electrical cord assembly having a plurality of electrically isolated conductors at least partly retained within the channel, the electrical cord assembly having a first end proximal the neck region and extending to a second end proximal at least one of the elbow region and the first wrist opening or the second wrist opening. At least one of the right sleeve and the left sleeve can also include a retainer configured to be affixed to an electronic game controller. At least one of the right sleeve and the left sleeve can also include an electronic device pocket proximal first wrist opening or the second wrist opening and comprising a substantially transparent window configured to permit viewing of a display of an electronic device secured within the electronic device pocket. The hooded garment can also include one or more affixment points configured to removably affix ornamental patches to the hooded garment. The back region can also include a vertical pocket having an opening formed in an upper half of the back region and defining a space having a depth between the neck region and the waist region that is longer than a width between a left torso region and a right torso region. The vertical pocket can be configured to hold a first portion a personal computer (PC) gaming keyboard in a vertical orientation, and a second portion of the keyboard visibly extends vertically through the opening toward the neck region.

In some aspects, a hooded garment includes a torso section extending from a waist region to a neck region, wherein the torso section has a right torso region, a left torso region, a chest region, and a back region, a hood extending upward from the neck region and having a front opening, a right sleeve extending from a right shoulder region of the right torso region and having a first wrist opening, and a left sleeve extending from a left shoulder region of the left torso region and having a second wrist opening, wherein at least one of the right sleeve and the left sleeve also includes a channel having at least a first opening proximal the neck region and a second opening proximal at least one of an elbow region and the first wrist opening or the second wrist opening.

Various embodiments can include some, all, or none of the following features. The torso section can include at least one of a front right pocket having a first opening in the right torso region proximal the waist region on the chest region, the first opening being at least partly oriented toward the left torso region across the chest region, and a front left pocket having a second opening in the left torso region proximal the waist region on the chest region, the second opening being at least partly oriented toward the right torso region across the chest region. The torso section can include at least one of a back right pocket having a first opening in the right torso region proximal the waist region on the back region, the first opening being at least partly oriented toward the left torso region across the back region, and a back left pocket having a second opening in the left torso region proximal the waist region on the back region, the second opening being at least partly oriented toward the right torso region across the back region. The hooded garment can also include an electrical cord assembly having a plurality of electrically isolated conductors at least partly retained within the channel, the electrical cord assembly having a first end proximal the neck region and extending to a second end proximal at least one of the elbow region and the first wrist opening or the second wrist opening. At least one of the right sleeve and the left sleeve can also include a retainer configured to be affixed to an electronic game controller. At least one of the right sleeve and the left sleeve can also include an electronic device pocket proximal the first wrist opening or the second wrist opening and having a substantially transparent window configured to permit viewing of a display of an electronic device secured within the electronic device pocket. The hooded garment can also have one or more affixment points configured to removably affix ornamental patches to the hooded garment. The back region can also have a vertical pocket having an opening formed in an upper half of the back region and defining a space having a depth between the neck region and the waist region that is longer than a width between a left torso region and a right torso region. The vertical pocket can be configured to hold a first portion of a personal computer (PC) gaming keyboard in a vertical orientation, and a second portion of the keyboard visibly extends vertically through the opening toward the neck region.

In certain aspects, a hooded garment includes a torso section extending from a waist region to a neck region, wherein the torso section has a right torso region, a left torso region, a chest region and a back region, a hood extending upward from the neck region and having a front opening, a right sleeve extending from a right shoulder region of the right torso region and having a first wrist opening, and a left sleeve extending from a left shoulder region of the left torso region and having a second wrist opening, wherein at least one of the right sleeve and the left sleeve also includes an electronic device pocket proximal the corresponding left wrist opening or right wrist opening and comprising a substantially transparent window configured to permit viewing of a display of an electronic device secured within the electronic device pocket.

Various embodiments can include some, all, or none of the following features. The torso section can include at least one of a front right pocket having a first opening in the right torso region proximal the waist region on the chest region, the first opening being at least partly oriented toward the left torso region across the chest region, and a front left pocket having a second opening in the left torso region proximal the waist region on the chest region, the second opening being at least partly oriented toward the right torso region across the chest region. The torso section can include at least one of a back right pocket having a first opening in the right torso region proximal the waist region on the back region, the first opening being at least partly oriented toward the left torso region across the back region, and a back left pocket having a second opening in the left torso region proximal the waist region on the back region, the second opening being at least partly oriented toward the right torso region across the back region. At least one of the right sleeve and the left sleeve can also include a channel having at least a first opening proximal the neck region and a second opening proximal at least one of an elbow region and the first wrist opening or the second wrist opening. The hooded garment can also include an electrical cord assembly having a plurality of electrically isolated conductors at least partly retained within the channel, the electrical cord assembly having a first end proximal the neck region and extending to a second end proximal at least one of the elbow region, the first wrist opening or the second wrist opening, and the electronic device pocket. At least one of the right sleeve and the left sleeve can also include a retainer configured to be affixed to an electronic game controller. The hooded garment can also include one or more affixment points configured to removably affix ornamental patches to the hooded garment. The back region can also include a vertical pocket having an opening formed in an upper half of the back region and defining a space having a depth between the neck region and the waist region that is longer than a width between a left torso region and a right torso region. The vertical pocket can be configured to hold a first portion of a personal computer (PC) gaming keyboard in a vertical orientation, and a second portion of the keyboard visibly extends vertically through the opening toward the neck region. The substantially transparent window can be a material that permits interaction between a user and a capacitive touchscreen user interface within the electronic device pocket.

In some aspects, an upper torso garment includes a torso section extending from a waist region to a neck region, where the torso section includes a front region and a back region. The front region is to be positioned adjacent a chest of a wearer of the garment, and the back region is to be positioned adjacent a back of the wearer. The torso section includes a left torso region and a right torso region, where the left torso region is positioned on a lateral left side of the torso section and the right torso region is positioned on a lateral right side of the torso section. The garment also includes a first reversed pocket positioned on the left lateral side of the front region of the torso section and proximate to the waist region, the first reversed pocket including a first pocket opening oriented at least partly toward the right torso region, and a second reversed pocket positioned on the right lateral side of the front region of the torso section and proximate to the waist region, the second reversed pocket including a second pocket opening oriented at least partly toward the left torso region. The garment further includes a right sleeve extending from a right shoulder region of the right torso region and having a first wrist opening, and a left sleeve extending from a left shoulder region of the left torso region and having a second wrist opening.

These and other aspects can include one or more of the following features. The first reversed pocket can include a double-pocket structure defining a first pocket chamber and a second pocket chamber. The first reversed pocket can include a first, external pocket fabric layer and a second, internal pocket fabric layer, where the space between the first pocket fabric layer and the second pocket fabric layer defines the first pocket chamber, and the space between the second pocket fabric layer and a body fabric layer of the torso section defines the second pocket chamber. The first pocket fabric layer can include a first peripheral edge defining a first pocket opening to the first pocket chamber, and the second pocket fabric layer can include a second peripheral edge defining a second pocket opening to the second pocket chamber, the second peripheral edge being offset from the first peripheral edge. The upper torso garment can further include a holster pocket formed entirely within in the first pocket chamber or the second pocket chamber. The second reversed pocket can include a double-pocket structure defining a third pocket chamber and a fourth pocket chamber. The second reversed pocket can include a third, external pocket fabric layer and a fourth, internal pocket fabric layer, where the space between the third pocket fabric layer and the fourth pocket fabric layer defines the third pocket chamber, and the space between the fourth pocket fabric layer and a body fabric layer of the torso section defines the fourth pocket chamber. The third pocket fabric layer can include a third peripheral edge defining a third pocket opening to the third pocket chamber, and can include the fourth pocket fabric layer comprises a fourth peripheral edge defining a fourth pocket opening to the fourth pocket chamber, the fourth peripheral edge being offset from the third peripheral edge. The torso section can include at least one of a third reversed pocket positioned on the left lateral side of the back region of the torso section and proximate to the waist region, the third reversed pocket including a third pocket opening oriented at least partly toward the right torso region, or a fourth reversed pocket positioned on the right lateral side of the back region of the torso section and proximate to the waist region, the second reversed pocket including a second pocket opening oriented at least partly toward the left torso region. At least one of the right sleeve or the left sleeve can further include an opening proximal at least one of an elbow region of the right sleeve or the left sleeve, the first wrist opening, or the second wrist opening. The opening can be positioned at a rear side of the left sleeve or the right sleeve and adjacent to a wrist cuff of the left sleeve or a wrist cuff of the right sleeve. At least one of the right sleeve or the left sleeve can include an electronic device pocket positioned proximate to the first wrist opening or the second wrist opening, the electronic device pocket including a substantially transparent window to permit viewing of a display of an electronic device secured within the electronic device pocket. The electronic device pocket can include a bottom fabric layer, a touch plastic layer, and an electronic device pocket chamber defined between the bottom fabric layer and the touch plastic layer, the touch plastic layer connected to the bottom fabric layer along at least a portion of a periphery of the touch plastic layer, the touch plastic layer defining the substantially transparent window. The bottom fabric layer can be connected to or formed integrally in a fabric layer of the at least one of the right sleeve or the left sleeve. The touch plastic layer can include an opening through the touch plastic layer to allow passage of the electronic device into and out of the electronic device pocket chamber. The upper torso garment can further include a lapel pocket on the front region of the torso section, the lapel pocket including a lapel pocket opening to a lapel pocket chamber. The lapel pocket can include an internal card pocket formed entirely within in the lapel pocket chamber. The garment can be formed from fabric including spandex, the fabric to provide comfort and flexibility to the wearer. The fabric can include a combination of fleece and spandex. The first reversed pocket can include a zipper to selectively close the first pocket opening, and the second reversed pocket can include a zipper to selectively close the second pocket opening.

In certain aspects, an upper torso garment includes a torso section extending from a waist region to a neck region, where the torso section includes a front region and a back region, the front region to be positioned adjacent a chest of a wearer of the garment, and the back region to be positioned adjacent a back of the wearer, the torso section including a left torso region and a right torso region, the left torso region positioned on a lateral left side of the torso section and the right torso region positioned on a lateral right side of the torso section. The back region includes a vertical pocket having a pocket opening formed in an upper half of the back region and defining a space having a depth between the neck region and the waist region that is longer than a width between the left torso region and the right torso region. The upper torso garment further includes a first quick-draw pocket positioned on the left lateral side of the front region of the torso section and proximate to the waist region, the first quick-draw pocket including a first pocket opening, and a second quick-draw pocket positioned on the right lateral side of the front region of the torso section and proximate to the waist region, the second quick-draw pocket including a second pocket opening.

These and other aspects can include one or more of the following features. The upper torso garment can include a right sleeve extending from a right shoulder region of the right torso region and having a first wrist opening, a left sleeve extending from a left shoulder region of the left torso region and having a second wrist opening, and an electronic device pocket positioned on at least one of the right sleeve proximate to the first wrist opening or the left sleeve proximate to second wrist opening, the electronic device pocket comprising a substantially transparent window configured to permit viewing of a display of an electronic device secured within the electronic device pocket. The electronic device pocket can include a bottom fabric layer, a touch plastic layer, and an electronic device pocket chamber defined between the bottom fabric layer and the touch plastic layer, the touch plastic layer connected to the bottom fabric layer along at least a portion of a periphery of the touch plastic layer, the touch plastic layer defining the substantially transparent window. The bottom fabric layer can be connected to or formed integrally in a fabric layer of the at least one of the right sleeve or the left sleeve. The touch plastic layer can include an opening through the touch plastic layer to allow passage of the electronic device into and out of the electronic device pocket chamber. At least one of the first quick-draw pocket or the second quick-draw pocket can include a double-pocket structure defining a first pocket chamber and a second pocket chamber. The upper torso garment can further include a third quick-draw pocket positioned on the left lateral side of the back region of the torso section and proximate to the waist region, the third quick-draw pocket including a third pocket opening, and a fourth quick-draw pocket positioned on the right lateral side of the back region of the torso section and proximate to the waist region, the fourth quick-draw pocket including a fourth pocket opening. At least one of the third quick-draw pocket or the fourth quick-draw pocket can include a double-pocket structure defining a first pocket chamber and a second pocket chamber. The vertical pocket can hold at least a portion a personal computer gaming keyboard in a substantially vertical orientation. The first quick-draw pocket can be a first reversed quick-draw pocket where the first pocket opening is oriented at least partly toward the right torso region, and the second quick-draw pocket can be a second reversed quick-draw pocket where the second pocket opening is oriented at least partly toward the left torso region.

The garments described here may provide one or more of the following advantages. First, a garment can provide features that enhance an electronic gaming experience. Second, the garment can provide pockets that are oriented for use with electronic gaming accessories. Third, the garment can provide pockets that can be accessed in tight quarters and/or seated positions. Fourth, the garment can transport and display electronic gaming accessories. Fifth, the garment can provide features that enhance the visibility of promotional materials.

The details of one or more implementations are set forth in the accompanying drawings and the description below. Other features and advantages will be apparent from the description and drawings, and from the claims.

DETAILED DESCRIPTION

Figure 1A:
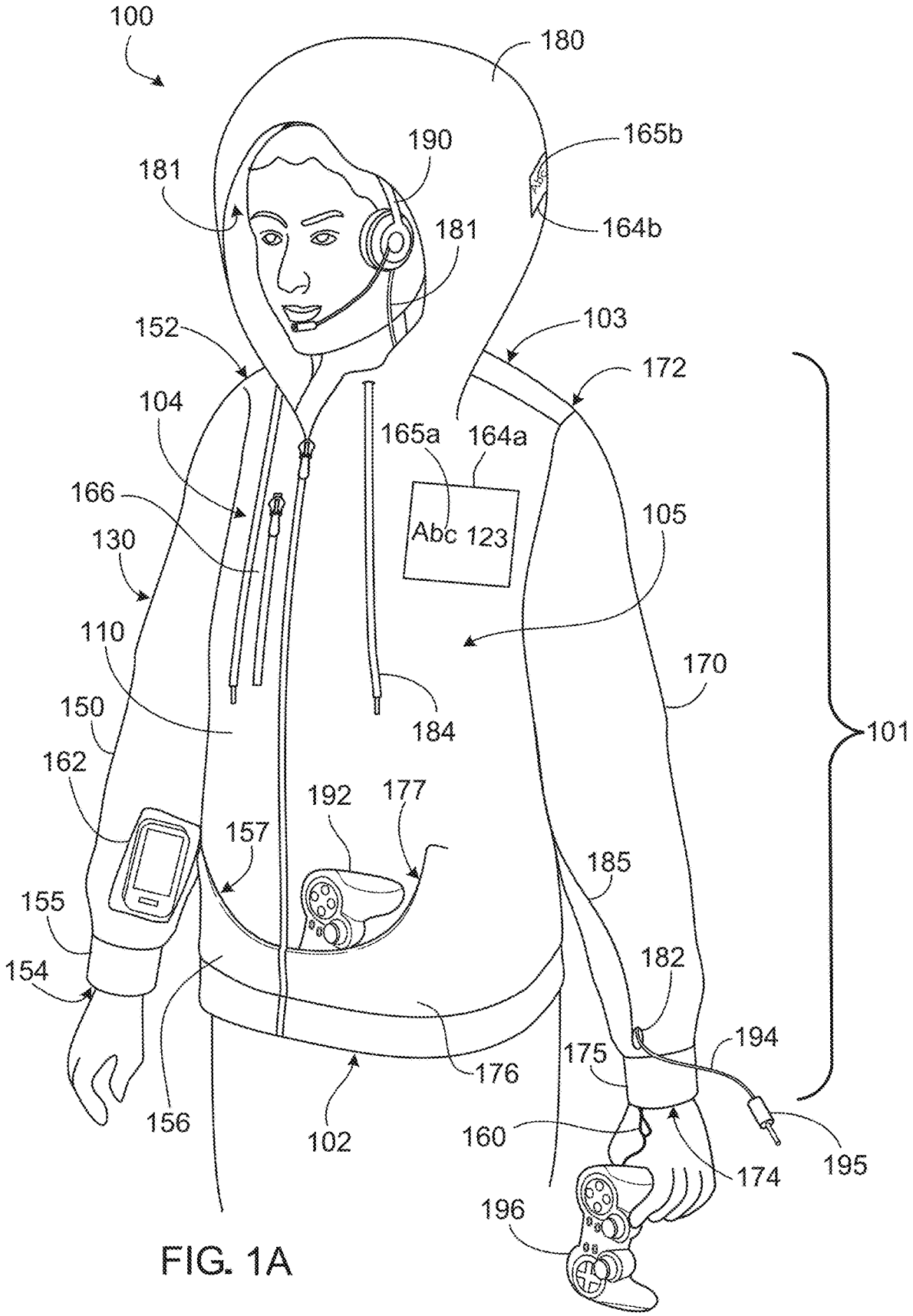
FIGS. 1A-1C are a front views of an example garment.

This document describes an upper-wear (upper torso) garment with features that can enhance the wearer's ability to organize, transport, and use electronic devices such as electronic gaming equipment. Electronic gaming enthusiasts often prefer to play using their own personally selected and/or customized gaming controllers, mice, keyboards, communication headsets, and other equipment. Some electronic gaming enthusiasts also wear clothing or accessories that can help them avoid external distractions and better focus on their game displays. For some gamers, the basic garment of choice is a hooded garment, commonly referred to as a "hoodie", which can be drawn over the player's head and drawn partly closed about the wearer's face to block out portions of the wearer's peripheral vision and help the wearer maintain focus straight ahead (e.g., toward their gaming screen). In the present disclosure, an upper torso garment is described with multiple pockets positioned at a front side of the garment, a rear of the garment, on one or more sleeves of the garment, or a combination of these locations, and can include an oversized hood (e.g., to allow space for headphones or other headgear), slit openings along a sleeve(s) of the garment for cable management, transparent and/or touch-screen compatible pocket layers (e.g., for interaction with a touch-screen device such as a smartphone or tablet), layered pockets, stretchable fabric material, a combination of these features, and/or other features benefitting a gaming enthusiast.

FIGS. 1A-8 show various views of an example garment 100. In general, the garment 100 is configured as an upper torso garment, such as a hooded garment, commonly referred to as a "hoodie", which includes pockets, cord organizers, and other features that are sized and oriented in configurations that address some of the unique equipment and needs of electronic gaming enthusiasts. The upper torso garment 100 is shown as a jacket-style hoodie with a central fastener (e.g., zipper or other fastener, described later). However, the upper torso garment 100 can be a hooded sweatshirt or other upper torso garment type with or without the central fastener.

Base Structure

The design of the example garment 100 is generally based on the design of hooded sweatshirts, commonly known as "hoodies". The garment 100 includes a torso region 101 extending from a waist region 102 to a neck region 103. The torso region 101 includes a chest region 110 (FIGS. 1A-1C) configured to substantially cover a wearer's chest, and a back region 130 (FIGS. 2A-3) configured to substantially cover the wearer's back. In the illustrated example, the chest region 110 includes a closure fastener 112, such as a zipper, that extends from the neck region 103 to the waist region 102. The closure fastener 112 is configured to open and reclose to ease the process of donning and removing the garment 100. In some embodiments, the closure fastener 112 may extend only part of the way from the neck region 103 to the waist region 102 (e.g., a half-hoodie). In some embodiments, the closure fastener 112 may be omitted (e.g., a pullover hoodie).

A right sleeve 150 extends from a right shoulder region 152 of a right torso region 104 and has a wrist opening 154. A left sleeve 170 extends from a left shoulder region 172 of a left torso region 105 and has a wrist opening 174. In the illustrated embodiment, the right wrist opening 154 is bordered by a radially expandable cuff 155 and the left wrist opening 174 is bordered by a radially expandable cuff 175. The cuffs 155, 175 are partly elastic and configured to at draw the wrist openings 154, 174 at least partly closed against the wearer's wrists.

Hood

The garment 100 includes a hood 180. The hood 180 extends upward from the neck region 103. The hood 180 is configured to be pulled up and over much of the wearer's head when in use, and has a front opening 181 for the wearer's face. A drawstring 184 is threaded through a passageway (not shown) within the periphery of the front opening 181. In use, the drawstring 184 can be tensioned in order to draw the front opening 181 at least partly closed around the wearer's face.

The hood 180 of the example garment 100 differs from the hoods of traditional "hoodies" in several ways. For example, the hood 180 is oversized compared to traditional hoods. In some examples, the hood 180 is configured to provide room for not just the wearer's head, but also to provide room for a communication headset 190 worn by the wearer. The hood 180 is also constructed to provide relatively greater acoustic insulation compared to traditional hoods. The hood 180 is made up of two or more layers of cloth and/or sound deadening materials. In use, the hood 180 can provide at least partial acoustic isolation for the wearer. In some implementations, compared to traditional hoods, the hood 180 can provide relatively greater immersion in a game or other task by at least partly isolating the wearer from audible distractions beyond the game (e.g., to help focus on sounds provided by the communication headset 190).

In another example, the hood 180 is configured to project the front opening 181 forward beyond the wearer's face. In use, this additional depth can be used to intentionally reduce the wearer's peripheral vision (e.g., to provide "blinders" to block out distractions around a gaming screen). In some implementations, compared to traditional hoods, the hood 180 can provide relatively greater immersion in a game or other task by at least partly isolating the wearer from visual distractions beyond the game (e.g., to help focus on the gaming screen). In some implementations, the hood 180 can also be used to retain gaming or other accessories. For example, the wearer can store the communication headset 190 in the hood 180 when the hood 180 is down.

While FIGS. 1A-8 show the hood 180 as oversized, the example garment 100 can include a different style hood, such as a conventional hood. In some implementations, the hood 180 can be excluded altogether (e.g., where the example garment 100 forms a sweatshirt or zippered sweatshirt), or the hood 180 can be selectively separable from the rest of the garment 100 via fasteners (e.g., snaps, zipper, buttons, or other).

Keyboard Sheath

Figure 2A:
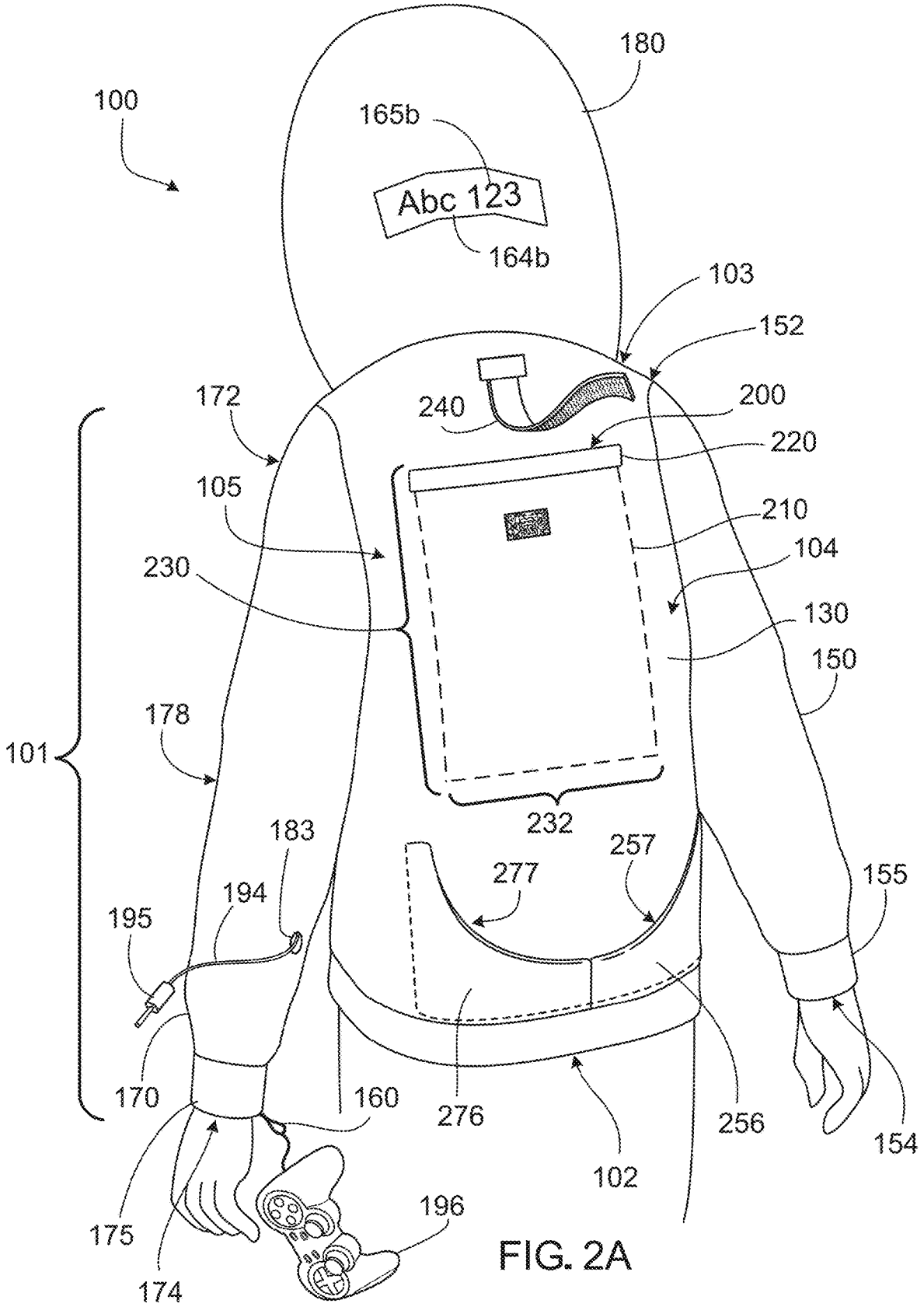
FIGS. 2A-2C are a rear views of the example garment of FIGS. 1A-1C.
Figure 2B:
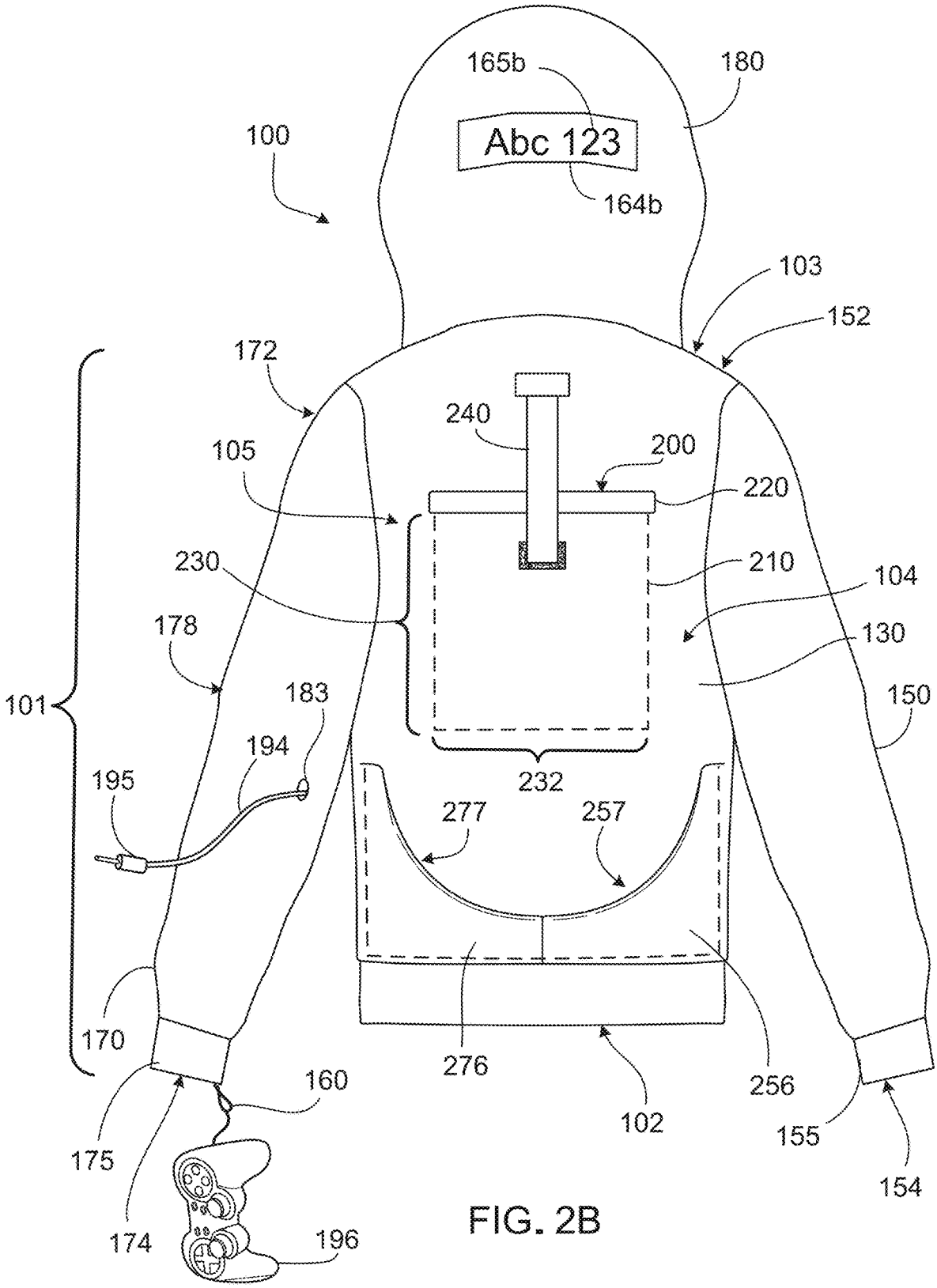
Figure 2C:
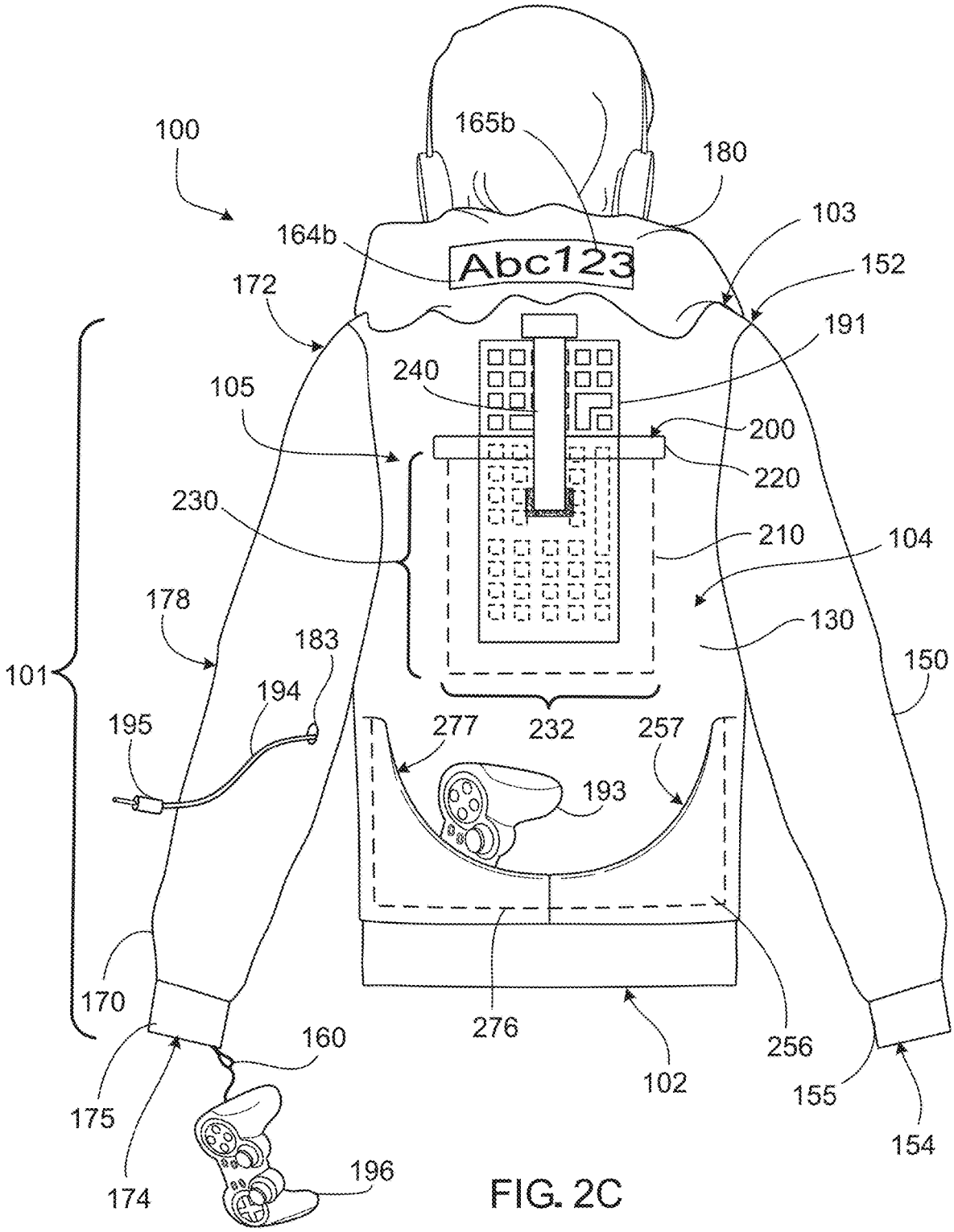
Figure 3:
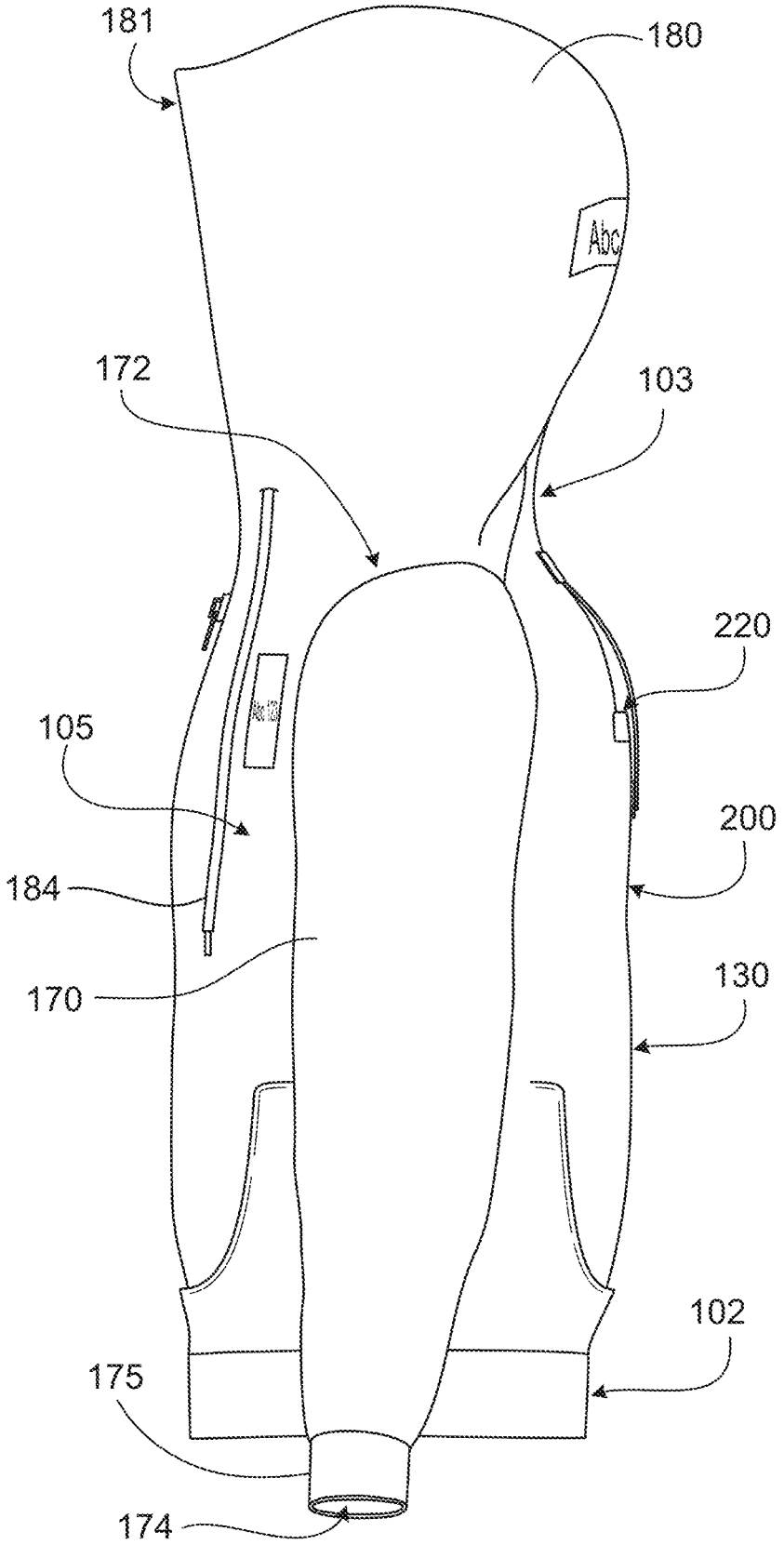
FIG. 3 is a left side view of the example garment of FIGS. 1A-2C.
Figure 4:
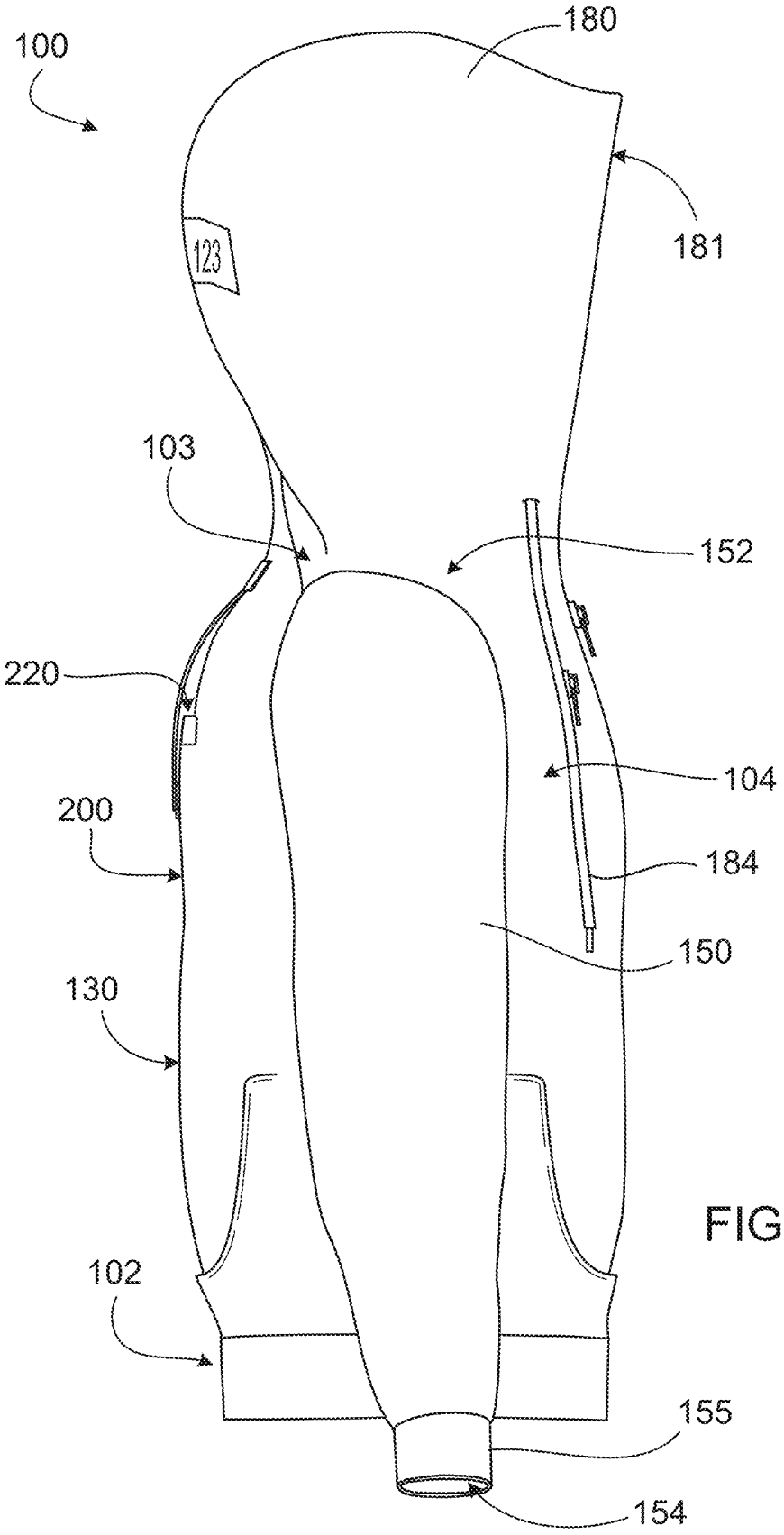
FIG. 4 is a left side view of the example garment of FIGS. 1A-3.
Figure 5:
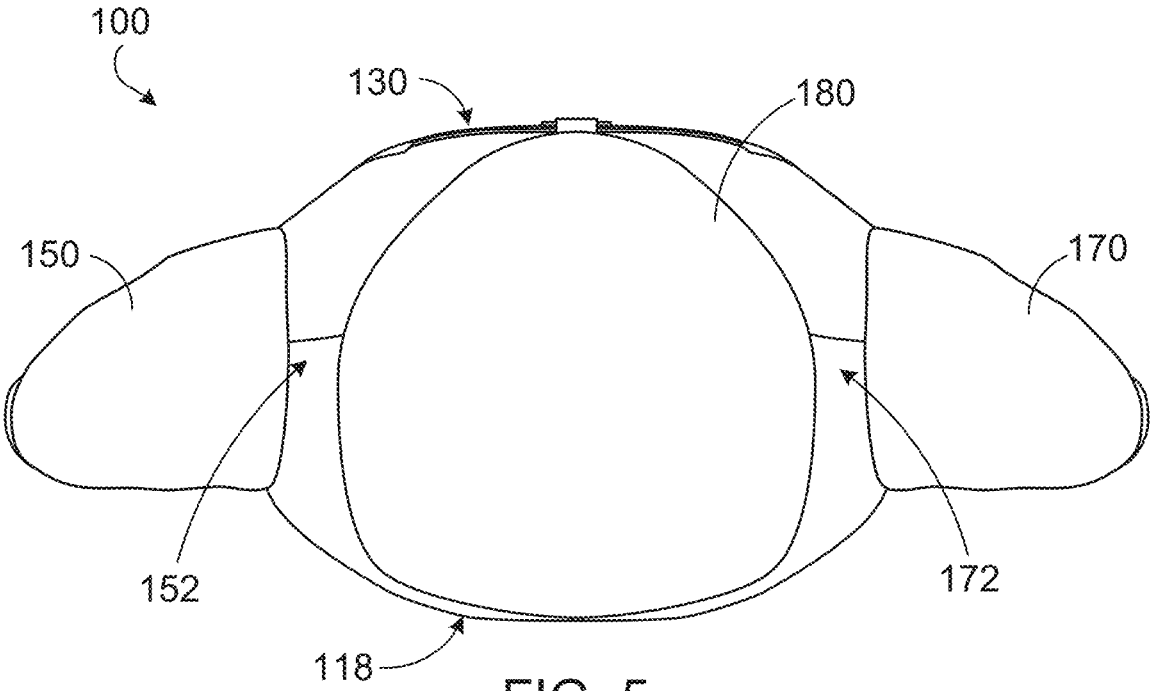
FIG. 5 is a top view of the example garment of FIGS. 1A-4.
Figure 6:
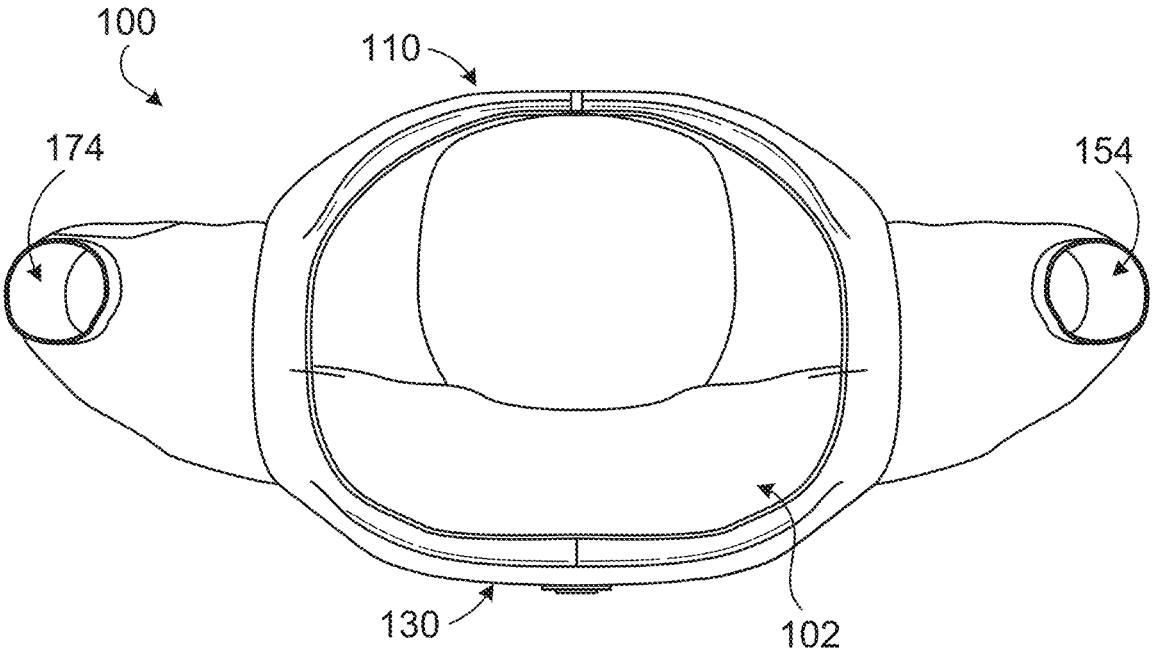
FIG. 6 is an underside view of the example garment of FIGS. 1A-5.

Referring mostly now to FIGS. 2A-2C, the example garment 100 includes a keyboard sheath 200. The keyboard sheath 200 is a vertically oriented pocket 210 in the back region 130. The keyboard sheath 200 includes an opening 220 formed in an upper half of the back region 130 and defines a space that is proximal the vertical center of the back region 130. The space defined by the keyboard sheath 200 has a depth 230 between the neck region 103 and the waist region 102 that is longer than a width 232 between the left torso region 105 and the right torso region 104. The opening 220 extends in a generally horizontal direction relative to the orientation in which the garment 100 is typically worn (e.g., extending between a location proximal the right shoulder region 152 and the left shoulder region 172). As such, the opening 220 provides primarily vertical access to the pocket 210. In some embodiments, configuration of the keyboard sheath 200 can resemble a kangaroo's pouch.

The pocket 210 can be formed on the garment 100 in a variety of ways. For example, the pocket 210 can be formed by a sheet of material that is sewn, adhered, integrated with, or otherwise coupled to the garment 100 on either an exterior surface of the rear of the garment 100 or an interior surface of the rear of the garment 100. In the example garment 100 of FIGS. 1A-8, the pocket 210 is shown as having been formed by a pocket fabric coupled to the interior fabric surface of the back of the garment 100, where the pocket space is formed between the pocket fabric and the interior surface of the back fabric of the garment 100. However, the pocket 210 can instead be formed by coupling a pocket fabric to the exterior surface of the back of the garment 100, where the pocket space is formed between the pocket fabric and the exterior surface of the back fabric of the garment 100. In some instances, the pocket 210 can be formed between two (or more) fabric pieces that extend from the pocket opening 220 into an interior of the garment. The two (or more) fabric pieces may or may not be coupled to the interior surface of the back fabric of the garment 100 at a periphery of the pocket 210.

In some embodiments, the dimensions of the pocket 210 can be selected to accommodate on the size of a typical, full-size personal computer (PC) gaming keyboard. For example, a PC keyboard can be about 17 inches wide and 6 inches deep. In such an example, the opening 220 can be a bit wider than 6 inches in order to accommodate rotated, vertical insertion of the keyboard, and the depth 230 can be about 10 to 18 inches deep (e.g., 13 inches), extending substantially vertically from the pocket opening 220. The opening 220 of the pocket 210 can include a welt along the lateral length (i.e., horizontal length) of the opening 220 on the top edge of the pocket 210. The welt at the top edge of the pocket 210 provides a structured edge to the opening 220 of the pocket 210, which can allow for easier identification of the pocket edge to the wearer, especially when the wearer is wearing the garment 100 and cannot directly see the pocket edge. The welt can also provide cushion to the edge of the pocket opening 220.

Referring now to FIG. 2C, the garment 100 is shown with the keyboard sheath 200 in an example of use. In general, the vertical pocket 210 is configured to hold most (e.g., half or more) of a personal computer (PC) gaming keyboard 191 in a vertical orientation (e.g., with width of the keyboard rotated into the vertical direction). The remainder of the keyboard 191 visibly extends vertically through the opening 220 toward the neck region 103. For example, some gamers may consider their gaming keyboards to be very important and/or very personal tools of their trade, and the keyboard sheath 200 can provide a place where their personal keyboard can be transported while leaving their hands/arms free, while also displaying the keyboard (e.g., as a status symbol, to make brand/sponsor logos on the keyboard visible to others). While the keyboard sheath 200 of example garment 100 is described as able to hold a keyboard in the pocket space of the keyboard sheath 200, the pocket of the sheath 200 can be used to support and hold other articles in addition to or instead of a keyboard. For example, the sheath 200 can be used to hold other elongate items, such as snacks (e.g., elongate jerky sticks), drumsticks, speakers, portable docking stations, or other equipment.

In some implementations, the example garment 100 includes a retainer 240 configured to at least partly close the opening 220 of the sheath 200. In the illustrated example, the retainer 240 can be extended between the neck region 103 on the back region 130 and the opening 220 to hold the keyboard 191 in place and prevent it from falling out. The retainer 240 is substantial enough to retain the keyboard 191 while also permitting the upper portion to remain exposed (e.g., to be seen for status or sponsorship purposes). In the illustrated example, the retainer 240 is partly formed of hook-and-loop fastener, but in some embodiments other forms of fasteners may be used (e.g., snaps, buckles, magnets, buttons, elastic, laces, Velcro®, or other). In the example garment 100, the retainer 240 includes a strap that extends vertically over the opening 220 of the keyboard sheath 200 to selectively close the keyboard sheath 200 and at least partially secure contents within the keyboard sheath 200. However, in certain implementations of the garment 100, the retainer 240 can be excluded.

In some instances, the keyboard sheath (and any respective retainer 240) is excluded from the example garment.

Quick-Draw Reversed Pockets

Figure 7:
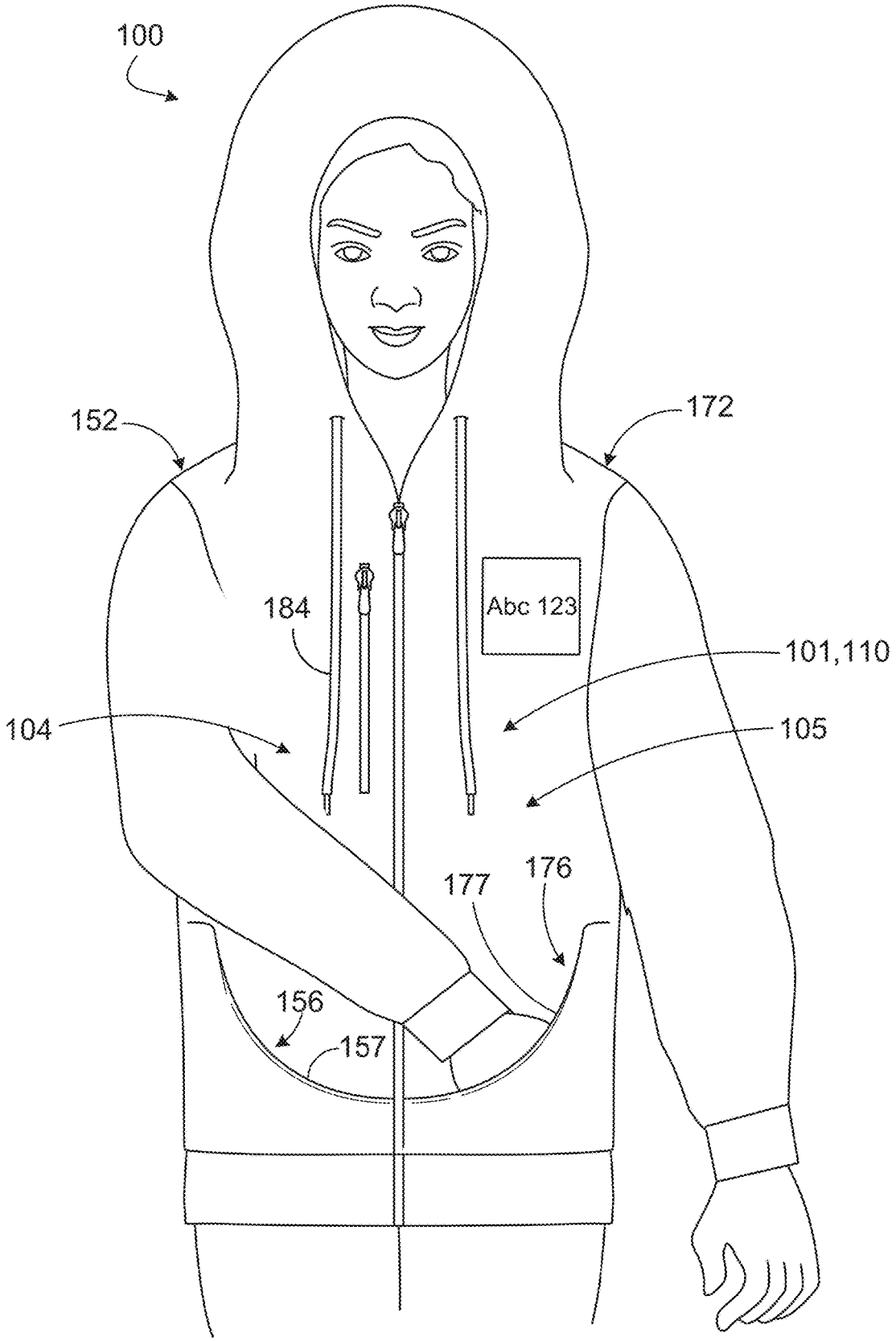
FIG. 7 is another front view of the example garment of FIGS. 1A-6.

Referring mainly to FIG. 7, the torso region 101 of the chest region 110 of the example garment 100 includes a front right pocket 156 and a front left pocket 176. The front right pocket 156 includes a right opening 157 in the right torso region 104 proximal the waist region 102 on the chest region 110. The front left pocket 176 includes a left opening 177 in the left torso region 105 proximal the waist region 102 on the chest region 110.

Traditional "hoodie" designs sometimes include front pockets, and these pockets are generally configured either as a horizontal tube across the wearer's abdomen (e.g., for pullover designs) or separate left and right pockets (e.g., for zip-up designs). In general, traditional pocket designs are oriented to make it easy for the right hand to enter the opening of the right pocket and for the left hand to enter the opening of the left pocket.

The front pockets 156, 176 of the garment 100 differ from traditional pockets. In general, the front pockets 156, 176 are "reversed" relative to traditional pockets. The right opening 157 is at least partly oriented toward the left torso region 105 across the chest region 110, and the left opening 177 is at least partly oriented toward the right torso region 104 across the chest region 110. For example, the right opening 157 opens diagonally toward the left shoulder region 172, while the left opening 177 opens diagonally toward the right shoulder region 152. In such orientations, the wearer can easily access the front right pocket 156 by reaching his/her left hand across his/her abdomen and through the right opening 157, and/or can easily access the front left pocket 176 by reaching his/her right hand across his/her abdomen and through the left opening 177.

In some implementations, the front pockets 156, 176 are oriented to provide easy access for a wearer of the garment 100 in confined spaces, such as a crowd or a racecar-style gaming seat. For example, the front pockets 156, 176 can provide easy access to a game controller 192 without the wearer having to stand up or extend an elbow far behind them in order to reach into the pockets. Instead, the user simply reaches his/her hand into the reversed opening on the opposite side of their stomach area. In some implementations, the front pockets 156, 176 can reduce the chances of theft or accidental loss of their contents. For example, with the front pockets 156, 176, a pickpocket may have to approach the wearer from the front rather than from the sides or back. In another example, the wearer may play games while in a somewhat reclined position in which traditional pockets with rearward openings would permit their contents to fall out, whereas the front pockets 156, 176 would become increasingly secure in a reclined position (e.g., more vertical and pouch-like relative to gravity).

Figure 8:
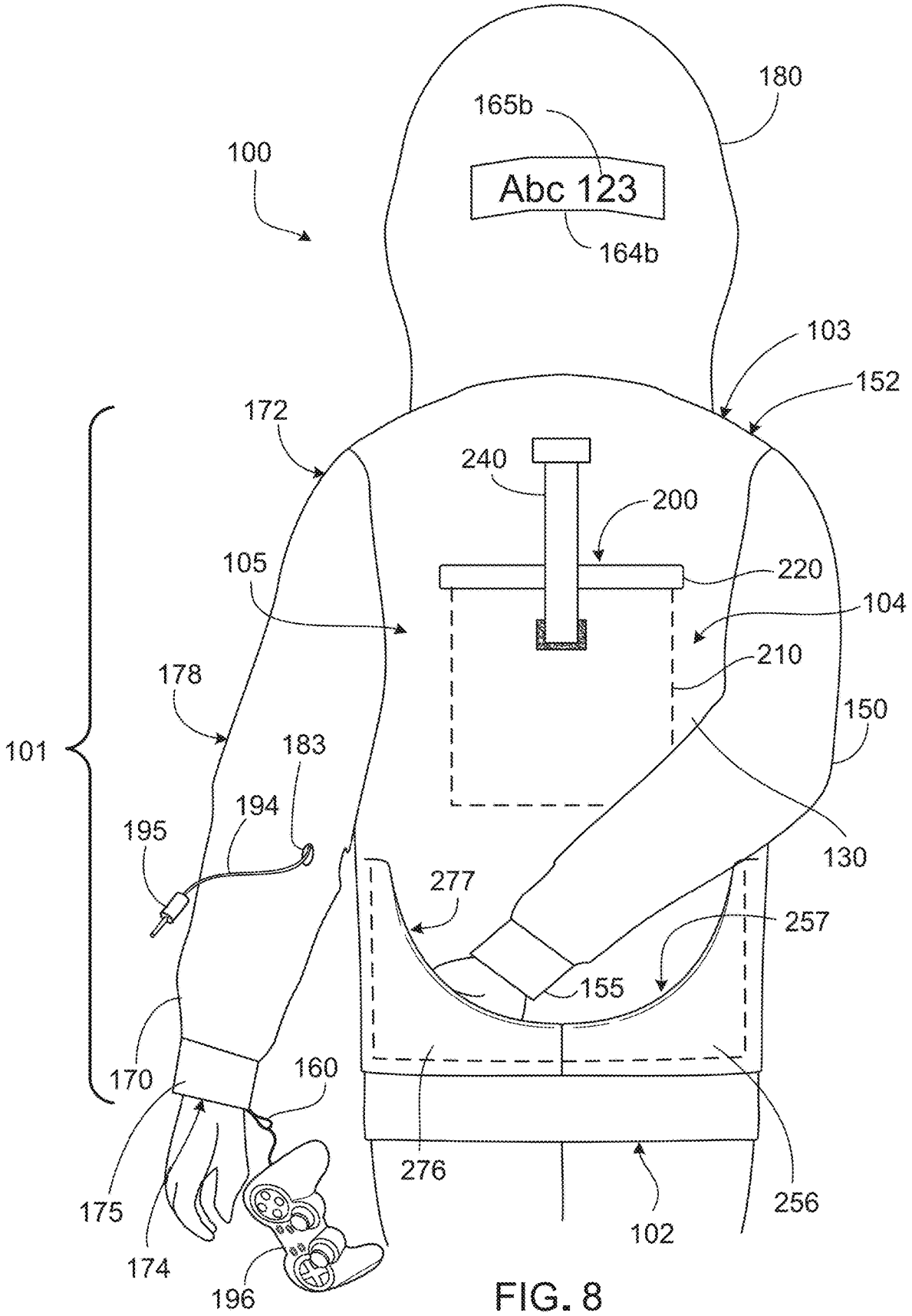
FIG. 8 is another rear view of the example garment of FIGS. 1A-7.

Referring mainly to FIG. 8, the torso region 101 of the back region 130 of the example garment 100 includes a back right pocket 256 and a back left pocket 276. The back right pocket 256 includes a right opening 257 in the right torso region 104 proximal the waist region 102 on the back region 130. The back left pocket 276 includes a left opening 277 in the left torso region 105 proximal the waist region 102 on the back region 130.

The right opening 257 is at least partly oriented toward the left torso region 105 across the back region 130, and the left opening 277 is at least partly oriented toward the right torso region 104 across the back region 130. For example, the right opening 257 opens diagonally toward the left shoulder region 172, while the left opening 277 opens diagonally toward the right shoulder region 152. In such orientations, the wearer can easily access the back right pocket 256 by reaching his/her left hand across his/her lower back and through the right opening 257, and/or can easily access the back left pocket 276 by reaching his/her right hand across his/her lower back and through the left opening 277. For example, the back pockets 256, 276 can provide easy access to a game controller 193 (FIG. 2C) by simply reaching behind his or her back.

The front pockets 156, 176 and rear pockets 256, 276 are shown in FIGS. 1A-8 as having a pocket edge opening shape that is concave, as described earlier. The concave edges of the pocket openings can be defined by the deep curve of the opening of the respective pockets, where the curve approximates a quarter-arc (i.e., an arc along about a quarter-circle). The shape of the edge of the fabric layer defining the opening of the front pockets 156, 176, rear pockets 256, 276, or both the front pockets and the rear pockets, can vary. For example, the shape of the edge of the fabric layer defining the openings of the pockets can have a straight-edge shape that extends substantially or exactly linearly from the edges of the openings, or the shape of the edge of the openings can have a slight arc to the edge of the pocket openings (for example, a concave arc that is less than a quarter-circle). Examples of these pocket edge shaped are described in more detail later.

Figure 9B:
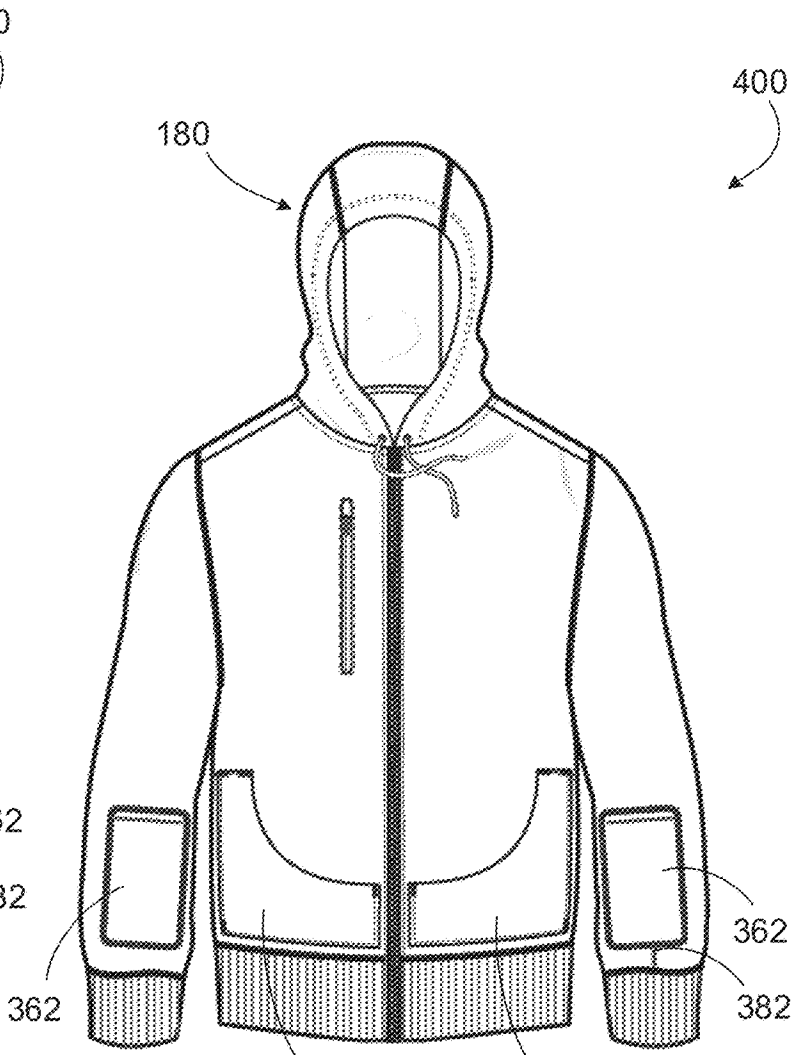
FIGS. 9A, 9B, and 9C are front views of example upper torso garments.
Figure 9A:
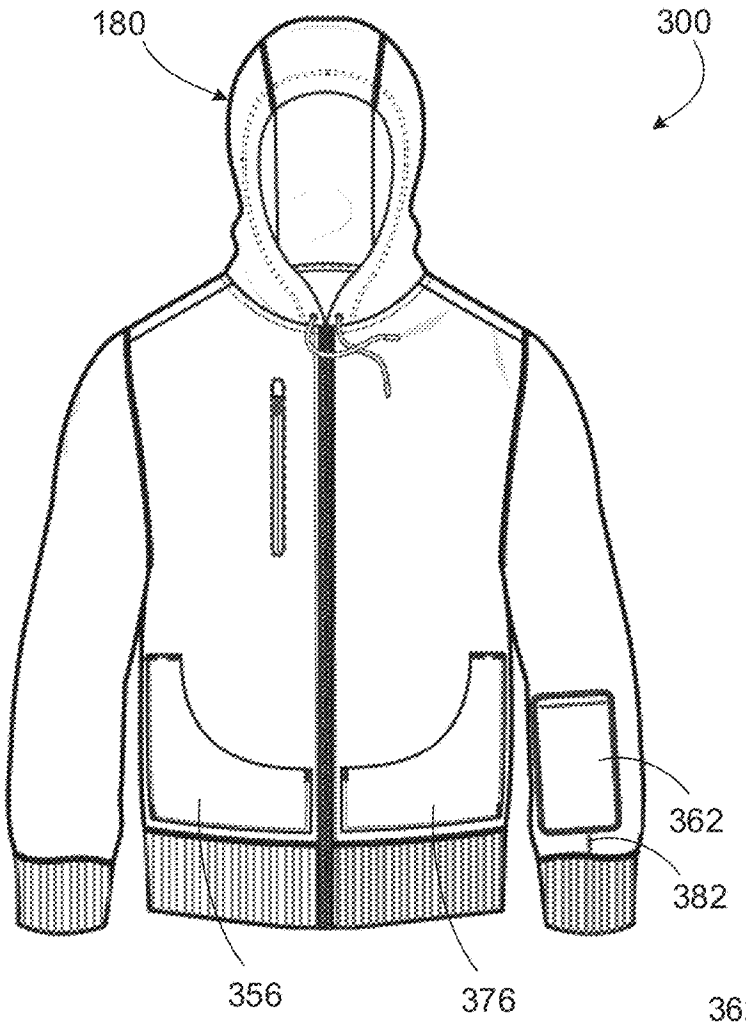
Figure 9C:
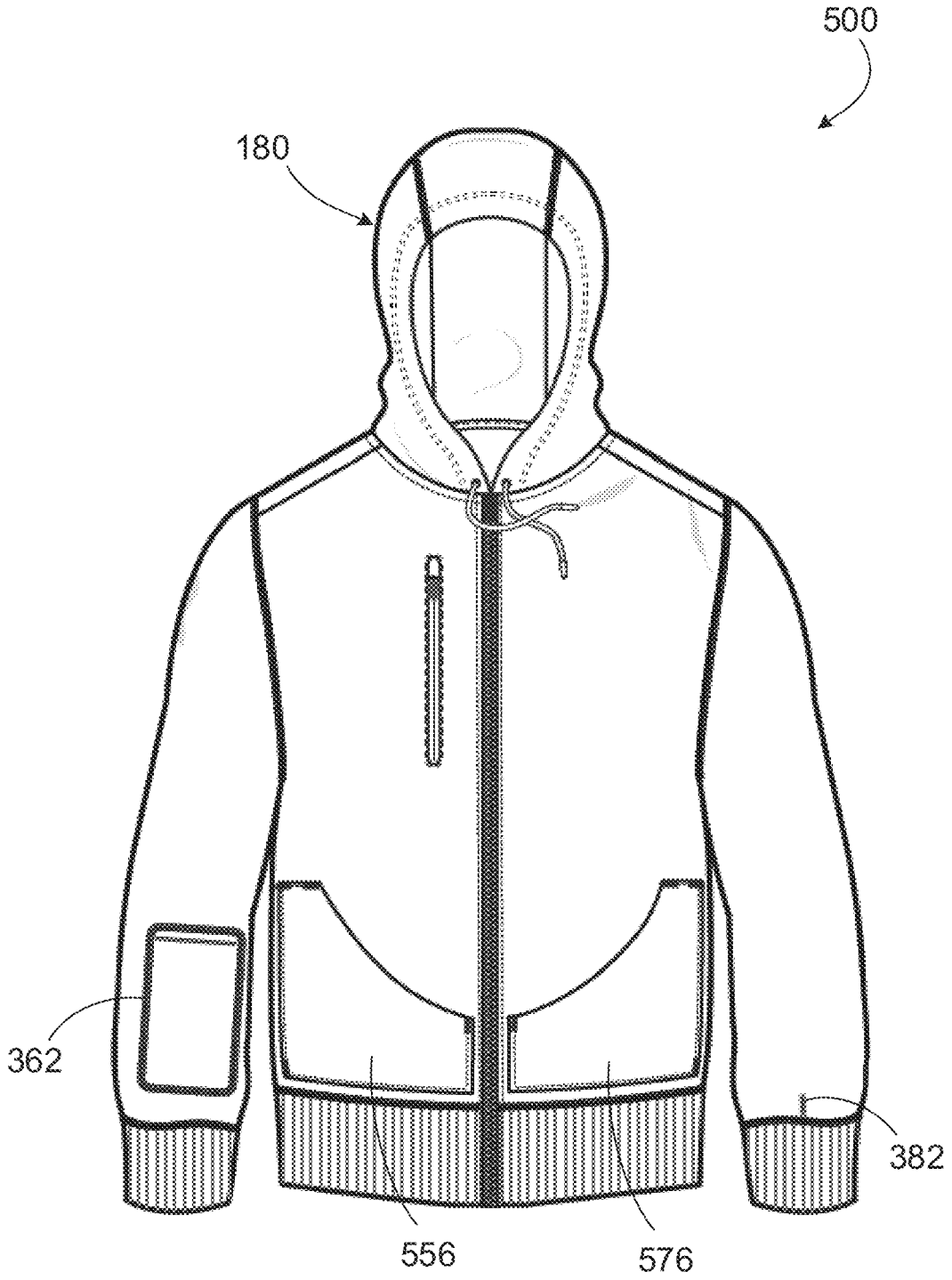

The reversed pockets can be formed on the garment 100 in a variety of ways. For example, the reversed pockets 156, 176, 256, and 276 can be formed by at least one ply of fabric material that is sewn, adhered, integrated with, or otherwise coupled to the garment 100 on either an exterior surface of the garment 100 or an interior surface of the garment 100. In the example garment 100 of FIGS. 1A-8, the reversed pockets 156, 176, 256, and 276 are shown as having been formed by a pocket fabric coupled to the interior fabric surface of the garment 100, where the pocket space is formed between the pocket fabric and the interior surface of the main fabric of the garment 100. However, the pockets can be formed differently on the garment. In some examples, the reversed pockets can be formed between two (or more) fabric pieces that extend from the respective pocket opening and into an interior of the garment. The two (or more) fabric pieces may or may not be coupled to the interior surface of the back fabric of the garment 100 at all or a portion of a periphery of the respective pocket. In some implementations, one or more or all of the pockets 156, 176, 256, 276 can instead be formed by coupling a pocket fabric to the exterior surface of the garment 100, for example at the front or back of the garment, where the pocket space is formed at least partially between the pocket fabric and the exterior surface of the garment 100 (as described in more detail later). For example, FIGS. 9A, 9B, and 9C are front views of example upper torso garments 300, 400, and 500, respectively. The example garments 300, 400, and 500 are similar to the example torso garment 100 of FIGS. 1A-8, except the example upper torso garments 300, 400, and 500 include reversed pockets that are coupled to the exterior of the respective garment, among other differences described later.

FIG. 9A is a front view of example upper torso garment 300 including front reversed pockets 356 and 376. Front reversed pockets 356 and 376 are like front reversed pockets 156 and 176 of example garment 100 of FIGS. 1A-8, except the front reversed pockets 356 and 376 are coupled to the garment 300 on an exterior of the garment 300 (as opposed to the pocket body being interior to the example garment). Further, the example garment 300 includes an electronic device pocket 362 that is similar to electronic device pocket 162 (described later) of example garment 100 of FIGS. 1A-8, except the electronic device pocket 362 is located on the left sleeve of the example garment 300 (instead of the right sleeve). The example garment 300 can include rear reversed pockets (not shown) that are similar in structure to example front reversed pockets 356 and 376, except are positioned at the rear of the garment 300 (similar to rear reversed pockets 256 and 276 of example garment 100 of FIGS. 1A-8). FIG. 9B is a front view of example upper torso garment 400. Example garment 400 is exactly like example upper torso garment 300 of FIG. 9A, except the example garment 400 includes two electronic device pockets 362, one located on each sleeve of the garment. FIG. 9C is a front view of example upper torso garment 500, which is exactly like example upper torso garment 300 of FIG. 9A, except the example garment 500 includes front reversed pockets 556 and 576 with a more gradual curve pocket opening than the front reversed pockets 356 and 376 of FIG. 9A, and example garment 500 includes the electronic device pocket 362 on the right sleeve of the garment 500 (instead of the left sleeve or both sleeves).

While this description (both earlier and later) makes reference to the example garment 100 of FIGS. 1A-8 and its respective features, the description can be applied to the example upper torso garments 300, 400, and 500 of FIGS. 9A-9C, and/or the example upper torso garment 600 of FIG. 13A. For example, references to front reversed pockets 156, 176, rear reversed pockets 256, 276, electronic device pocket(s) 162, and/or other features of example garment 100 can be applicable to front reversed pockets 356, 376, 556, 576, rear pockets (not shown in FIGS. 9A-9C), electronic device pocket(s) 362, and/or other features of example garment 300, 400, 500, and/or 600.

Figure 10A:
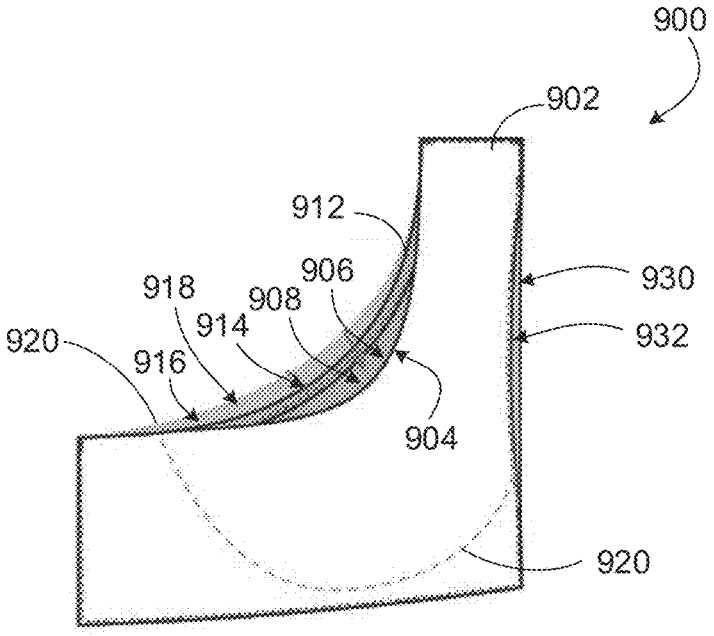
FIG. 10A is an exterior view of an example reversed pocket that can be used in the example garments of FIGS. 1A-9C.

The front pockets 156, 176 and rear pockets 256, 276 are shown FIGS. 1A-8 as each having a single respective pocket opening that opens to a single respective pocket chamber. In some implementations, one of, more than one of, or all of the front pockets 156, 176 or rear pockets 256, 276 can include a double-pocket structure, whereby the pocket volume includes two pocket chambers, for example, separated by a material layer (e.g., fabric layer). FIG. 10A is a front view of an example reversed pocket 900 that can be used in the front pocket 156, front pocket 176, rear pocket 256, or rear pocket 276 of FIGS. 1A-8, or in the front pocket 356, 376, 556, 576, or rear pockets of the example garment 300, 400, or 500 of FIGS. 9A-9C. FIG. 10A is an exterior view of the example reversed pocket 900, for example, in that the view is of the pocket 900 from outside of the pocket 900. The example reversed pocket 900 has a stacked pocket structure that, when attached to a garment (such as garment 100, 300, 400, or 500), forms two stacked pocket chambers: an inner pocket chamber (closer to the wearer) and an outer pocket chamber (farther from the wearer). The example reversed pocket 900 of FIG. 10A includes a first, external pocket fabric layer 902 and a second, internal pocket fabric layer 912. The first pocket fabric layer 902 has a peripheral edge 904 (e.g., a curved peripheral edge) that forms a part of a first pocket opening 906 of the reversed pocket 900, thereby forming a first pocket chamber 908 between the first pocket fabric layer 902 and the second pocket fabric layer 912. The second pocket fabric layer 912 has a second peripheral edge 914 (e.g., a curved peripheral edge) that forms a part of a second pocket opening 916 of the reversed pocket 900, thereby forming a second pocket chamber 918 between the second pocket fabric layer 912 and a body fabric layer 920 that the reversed pocket 900 is attached to. For example, a wearer of a garment (such as sweatshirt garment 100 of FIGS. 1-8 or example garment 300, 400, or 500 of FIGS. 9A-9C) that incorporates the example reversed pocket 900 can access either the first pocket chamber 908 or the adjacent second pocket chamber 918 between the second pocket fabric layer 912 and the body fabric layer 920 that the reversed pocket 900 is attached to. The wearer can store equipment or other items in the reversed pocket 900 with the option of separating a first subset of items in the first pocket chamber 908 from a second subset of items in the second pocket chamber 918. For example, a wearer of the garment 100 with the example pocket 900 can store a game controller, mouse, or other gaming device in one of the first pocket chamber 908 or the second pocket chamber 918, and can store other items (such as food, snacks, water bottle, other) separate from the game controller in the other of the first pocket chamber 908 or second pocket chamber 918.

The peripheral edge 914 of the second pocket fabric layer 912 is shown in FIG. 10A as offset from, but substantially matching the shape of, the peripheral edge 904 of the first pocket fabric layer 902. This offset can vary. In some instances, the offset is between ⅛ inch and two inches, such as ¼ inch, ½ inch, 1 inch, or another dimension. However, the shape of the peripheral edges 904 and 914 can vary. In some examples, the peripheral edge 914 follows the exact shape of the peripheral edge 904 and is positioned directly adjacent to the peripheral edge 904. In some examples, the peripheral edge 914 of the second pocket fabric layer 912 is a different shape than the peripheral edge 904 of the first pocket fabric layer 902. For example, the peripheral edge 904 of the first pocket fabric layer 902 can be a straight edge or a slight curved edge, whereas the peripheral edge 914 of the second pocket fabric layer 912 can be a deeper curved edge or another shape different from that of the first peripheral edge 904.

The second pocket fabric layer 912 can follow an entire periphery of the first pocket fabric layer 902, can follow only a portion of the periphery of the first pocket fabric layer 902, or follow none of the periphery of the first pocket fabric layer 902. In some instances, the second pocket fabric layer 912 has periphery that is less than, or internal to, the first pocket fabric layer 902. For example, FIG. 10A shows an internal periphery 922 of the second pocket fabric layer 912 as following a rounded, holster shape, and attaches to the first pocket fabric layer 902 (or body fabric layer 920) along the internal periphery. Depending on which fabric layer (first layer 902 or body fabric layer 920) the second fabric layer 918 attaches to at the internal periphery 920, either the first pocket chamber 908 or the second pocket chamber 918 is defined at least partially by the internal periphery 922.

In some instances, the reversed pocket 900 forms a third pocket opening 930 on the lateral side of the pocket 900 between an upper longitudinal end and a lower longitudinal end of the pocket 900. For example, the third pocket opening 930 provides access to a third pocket chamber 932 defined by two fabric plies that extend into an interior of the garment. The two fabric plies can be separate from the fabric of the garment itself, in that the two fabric plies are not integral with the body fabric 920, and instead are defined by the two additional plies of fabric material. The two plies of fabric material can be attached to the body fabric at an interior surface of the body fabric at all or a portion of a periphery of the third pocket chamber 932. In some instances, the two plies of material defining the third pocket chamber 932 can provide a fourth internal pocket in the garment, for example, between the body fabric 920 and the two plies of material forming the third pocket chamber 932 at an interior of the garment. This fourth internal pocket can be especially useful in garment embodiments that include a zipper or other central fastener, such that in an unfastened (e.g., unzipped) mode, the fourth internal pocket is easily accessed from an interior surface of the garment.

Figure 10B:
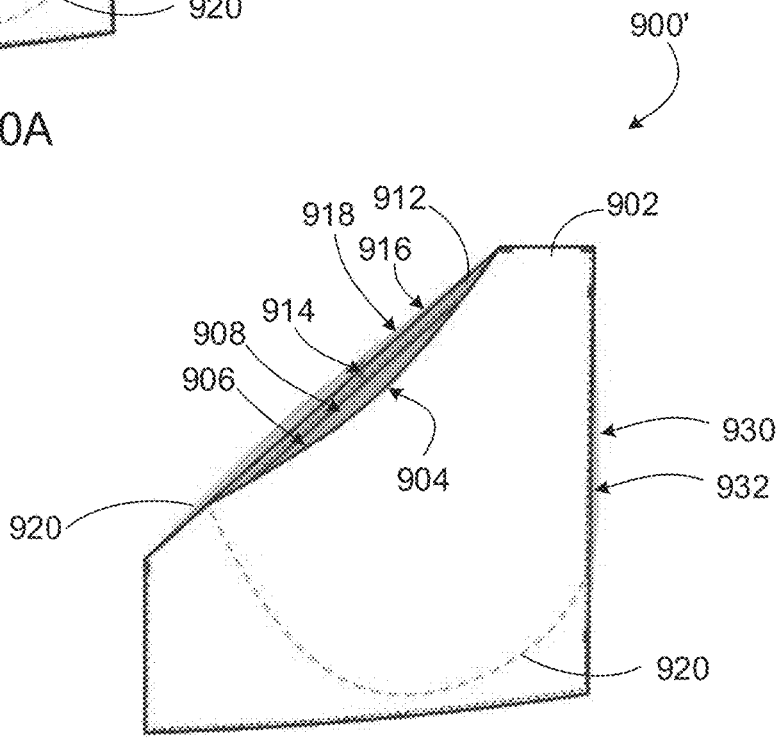
FIG. 10B is an exterior view of an example reversed pocket that can be used in the example garments of FIGS. 1A-9C.

FIG. 10B is an exterior view of an example reversed pocket 900' that is exactly like the example reversed pocket 900 of FIG. 10A, except the first pocket edge 904' and second pocket edge 914' are straight along the edge of the respective pockets, instead of curved along the pocket edges.

In some implementations, the second pocket fabric layer 914 (of pocket 900 or 900') forms an interior holster pocket of stretch-woven fabric material or other material. As described earlier, the interior holster pocket can be the first pocket chamber 908 or second pocket chamber 918, and can be a hidden pocket are of the pocket 900. In some implementations, the first pocket fabric layer 902, second pocket fabric layer 912, or both, can include a hidden holster pocket shaped to hold a wallet, credit card, identification card, or other similar items. For example, the hidden holster pocket can be similar to (i.e., take on the shape and structure of) the internal card pocket 1102 of FIG. 11, described later. The shape of this hidden holster pocket can vary, for example, based on the type of items intended to be secured in the hidden holster pocket. In some examples, such as when the wearer of the example garment 100 is a gaming enthusiast, the quick-draw pocket chambers of the front pockets and/or rear pockets provide a significant benefit to the wearer in a fast-paced gaming environment. For example, a wearer of the garment 100 can appreciate the ability to quickly draw a controller(s), mouse (mice), or other gaming device from one of the front pockets 156, 176 or rear pockets 256, 276, while also being able to discretely hold, in a substantially separate and hidden chamber of the hidden holster pocket of the front pockets 156, 176 or rear pockets 256, 276, personal items like credit cards, identification, and/or wallets for quick-draw access, as well.

The garment 100 (or garment 300, 400, or 500), the reversed pocket 900 (or reversed pocket 900'), or a combination of these, can be made of a variety of materials that promote comfort and flexibility for the wearer. For example, the fabric of the garment can include spandex, which can provide comfort to the wearer and flexibility to the pockets for greater adaptability of items stored in the pockets and a lesser likelihood of the pockets to bind. In some examples, the fabric can be fleece with spandex incorporated into the fabric.

One or more or all of the pocket openings of the quick-draw reversed pockets (e.g., such as the pockets 156, 176, 256, 276, 356, 376, 556, 576, 900, 900' described in FIGS. 1A-10B) can include a fastener, such as a zipper, hook-and-lip, button(s), or other type of fastener, to selectively open and close the respective pocket opening. For example, any one or more or all of the pocket openings (e.g., 157, 177, 257, 277, 906, 916, 930) can include a zipper to selectively open and close the respective pocket opening(s), such as to selectively access or securely store items in the respective pocket chamber. With particular reference to the example pocket 900 and/or 900', in certain instances, the first pocket opening 906 of both front quick-draw reversed pockets (e.g., 356 and 376) of FIG. 9A or 9B or both front quick-draw reversed pockets (e.g., 556 and 576) of FIG. 9C include a zipper, whereas the other pocket openings of the respective pocket(s) exclude a fastener. In some instances, the third pocket opening 930 of both front quick-draw reversed pockets (e.g., 356 and 376 of FIG. 9A or 9B, or 556 and 576 of FIG. 9C) include a zipper, whereas the other pocket openings of the respective pocket(s) exclude a fastener.

Quick-Draw Pockets

In some implementations, the example garment (100, 300, 400, or 500) can include forward quick-draw pockets instead of "reversed" quick-draw pockets at one or more of the pocket locations on the garment. Forward quick-draw pockets can take a variety of forms. For example, FIG. 13A is a front view of example upper torso garment 600 including front forward quick-draw pockets 656 and 676. The example garment 600 is like the example garment 300 of FIG. 9A, except the front forward pockets 656 and 676 are different. Front forward pockets 656 and 676 are like front reversed pockets 356 and 376 of example garment 300 of FIG. 9A, except the front forward pockets 656 and 676 have a different orientation and location of its respective pocket openings, described later. Further, the example garment 600 includes an electronic device pocket 662 that is similar to electronic device pocket 362 of example garment 300 of FIG. 9A. The example garment 600 can include rear-facing forward pockets (not shown) that are similar in structure to example front forward pockets 656 and 676, except are positioned at the rear of the garment 600 (similar to rear-facing reversed pockets 256 and 276 of example garment 100 of FIGS. 1A-8).

Figure 13A:
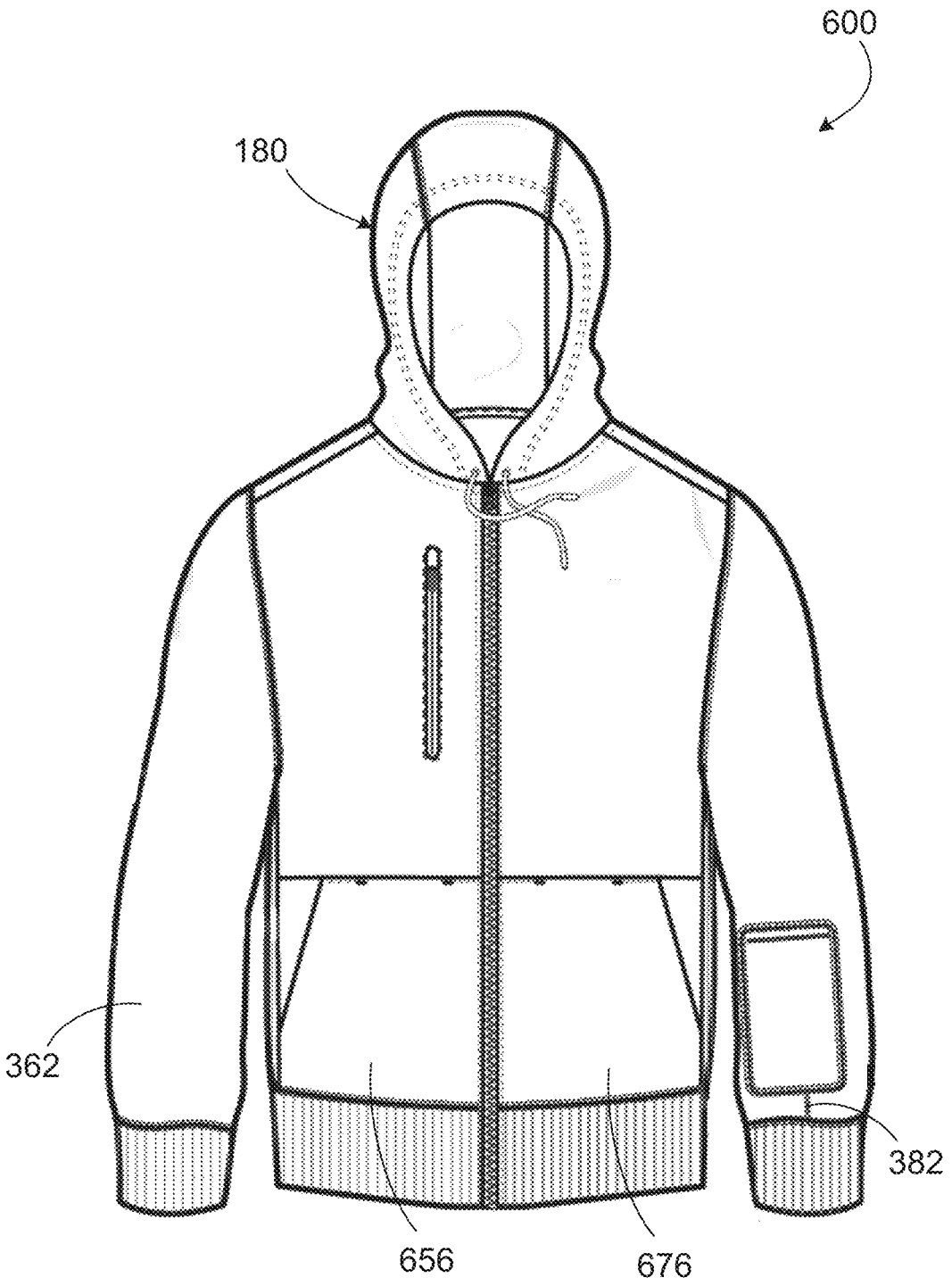
FIG. 13A is a front view of an example upper torso garment.
Figure 13B:
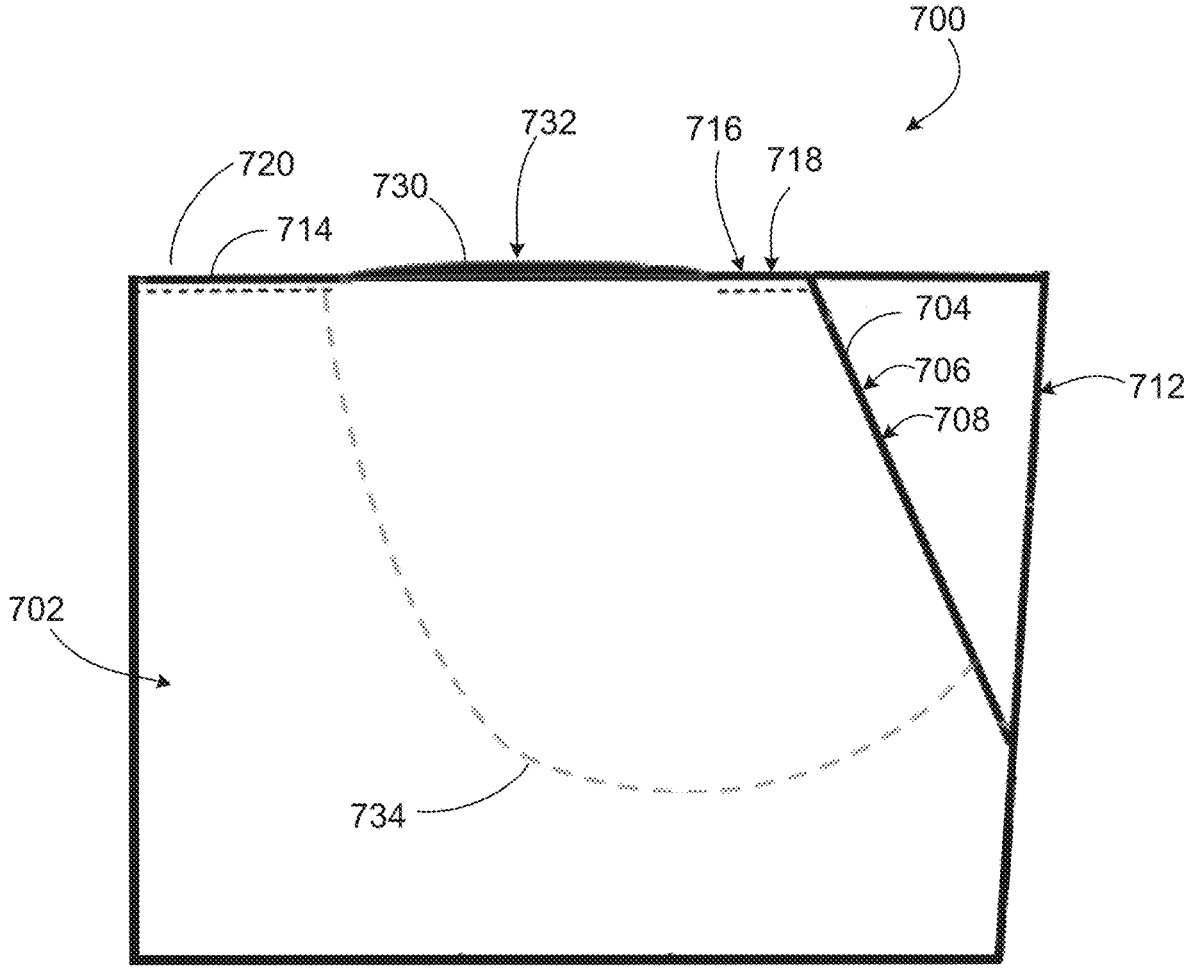
FIG. 13B is an exterior view of an example forward pocket that can be used in the example garment of FIG. 13A.

FIG. 13B is an exterior view of an example front forward pocket 700, which can be used in the front forward pockets 656 or 676 of FIG. 13A. The exterior view is of the pocket 700 from outside of the pocket 700. The example forward pocket 700 has a stacked pocket structure that, when attached to a garment (such as garment 600), forms at least two stacked pocket chambers: an inner pocket chamber (closer to the wearer), an outer pocket chamber (farther from the wearer), and in some instances, a holster pocket chamber within one or both of the inner pocket chamber or the outer pocket chamber. The example pocket 700 of FIG. 13B includes a first, external pocket fabric layer 702 and a second, internal pocket fabric layer 712. The first pocket fabric layer 702 has a peripheral edge 704 (e.g., straight, chamfered peripheral edge) that forms a part of a first pocket opening 706 of the forward pocket 700 at a lateral side of the pocket 700 (e.g., laterally outward side), thereby forming a first pocket chamber 708 between the first pocket fabric layer 702 and the second pocket fabric layer 712. The second pocket fabric layer 712 has a second peripheral edge 714 (e.g., a flat, top peripheral edge) that forms a part of a second pocket opening 716 of the forward pocket 700, thereby forming a second pocket chamber 718 between the second pocket fabric layer 712 and a body fabric layer 720 that the forward pocket 700 is attached to. For example, a wearer of a garment (such as sweatshirt garment 600 of FIG. 13A) that incorporates the example forward pocket 700 can access either the first pocket chamber 708 or the second pocket chamber 718 between the second pocket fabric layer 712 and the body fabric layer 720 that the forward pocket 700 is attached to. The wearer can store equipment or other items in the forward pocket 700 with the option of separating a first subset of items in the first pocket chamber 708 from a second subset of items in the second pocket chamber 718. For example, a wearer of the garment 100 with the example pocket 700 can store a game controller, mouse, or other gaming device in one of the first pocket chamber 708 or the second pocket chamber 718, and can store other items (such as food, snacks, water bottle, other) separate from the game controller in the other of the first pocket chamber 708 or second pocket chamber 718. In some instances, the wearer can store his/her hand in the first pocket chamber 708, and other items in the second pocket chamber 718.

In certain instances, the forward pocket 700 includes a third fabric layer 730 connected to the internal pocket fabric layer 712, and forms a third pocket opening 732 on the longitudinal top of the pocket 700. In some examples, the third pocket opening 732 can be formed adjacent to or proximate to the second pocket opening 716. The third fabric layer forms a third pocket chamber starting from the third pocket opening 732 that can include a periphery 734 that extends to some or all of the periphery of the second pocket chamber 718. For example, FIG. 13B shows the periphery 734 of the third pocket chamber as following a rounded, holster shape.

One or more or all of the pocket openings of the quick-draw pockets (e.g., such as those pockets described in FIGS. 13A and 13B) can include a fastener, such as a zipper, hook-and-lip, button(s), or other type of fastener, to selectively open and close the respective pocket opening. In some examples, the first pocket opening 706 includes a zipper to selectively open and close the first pocket opening 706, such as to selectively access or securely store items in the first pocket chamber 708. In certain instances, the first pocket opening 706 of both front quick-draw pockets 656 and 676 of FIG. 13A include a zipper, whereas the other pocket openings exclude a fastener.

Cord Keep

Figure 1B:
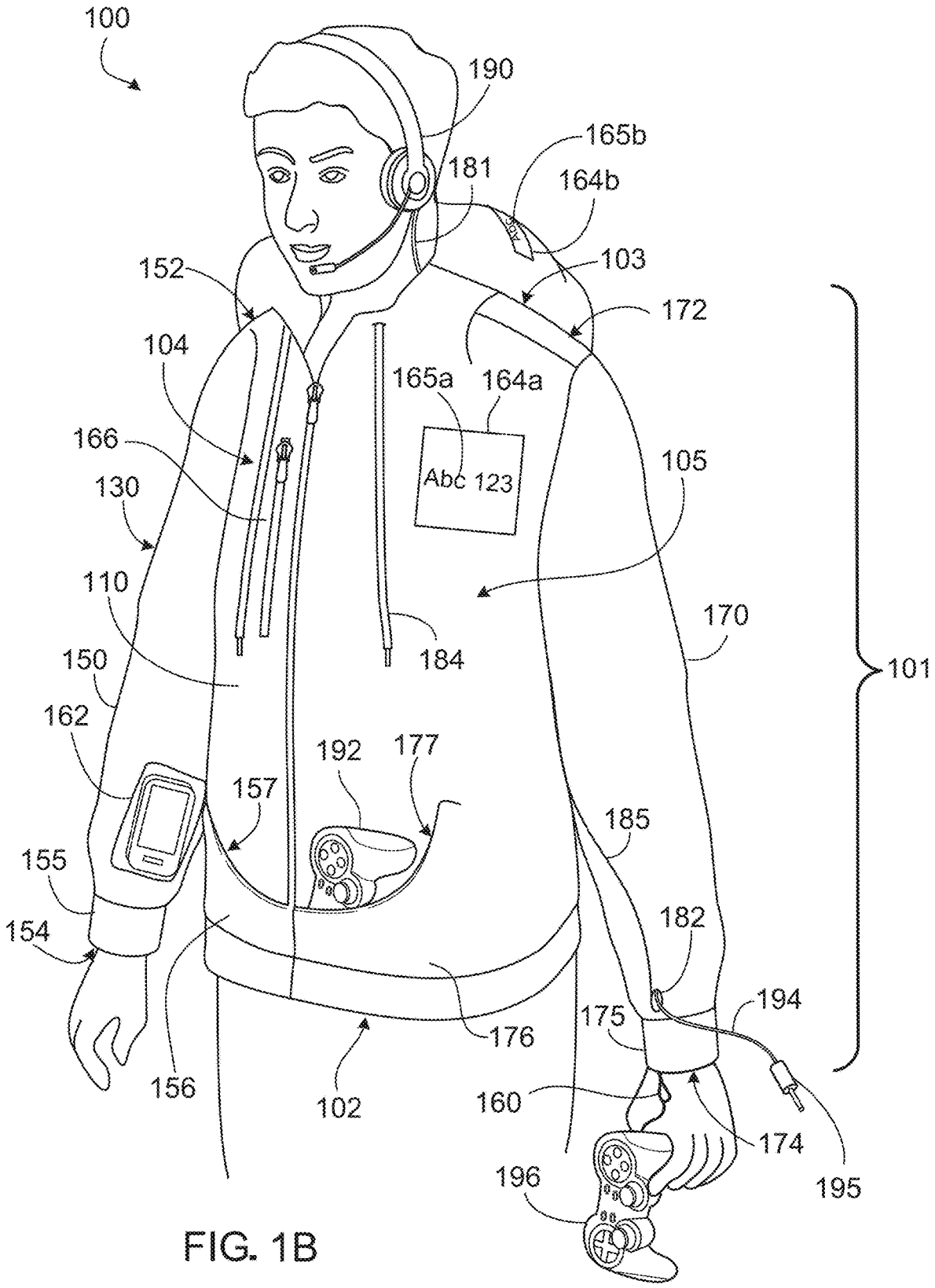
Figure 1C:
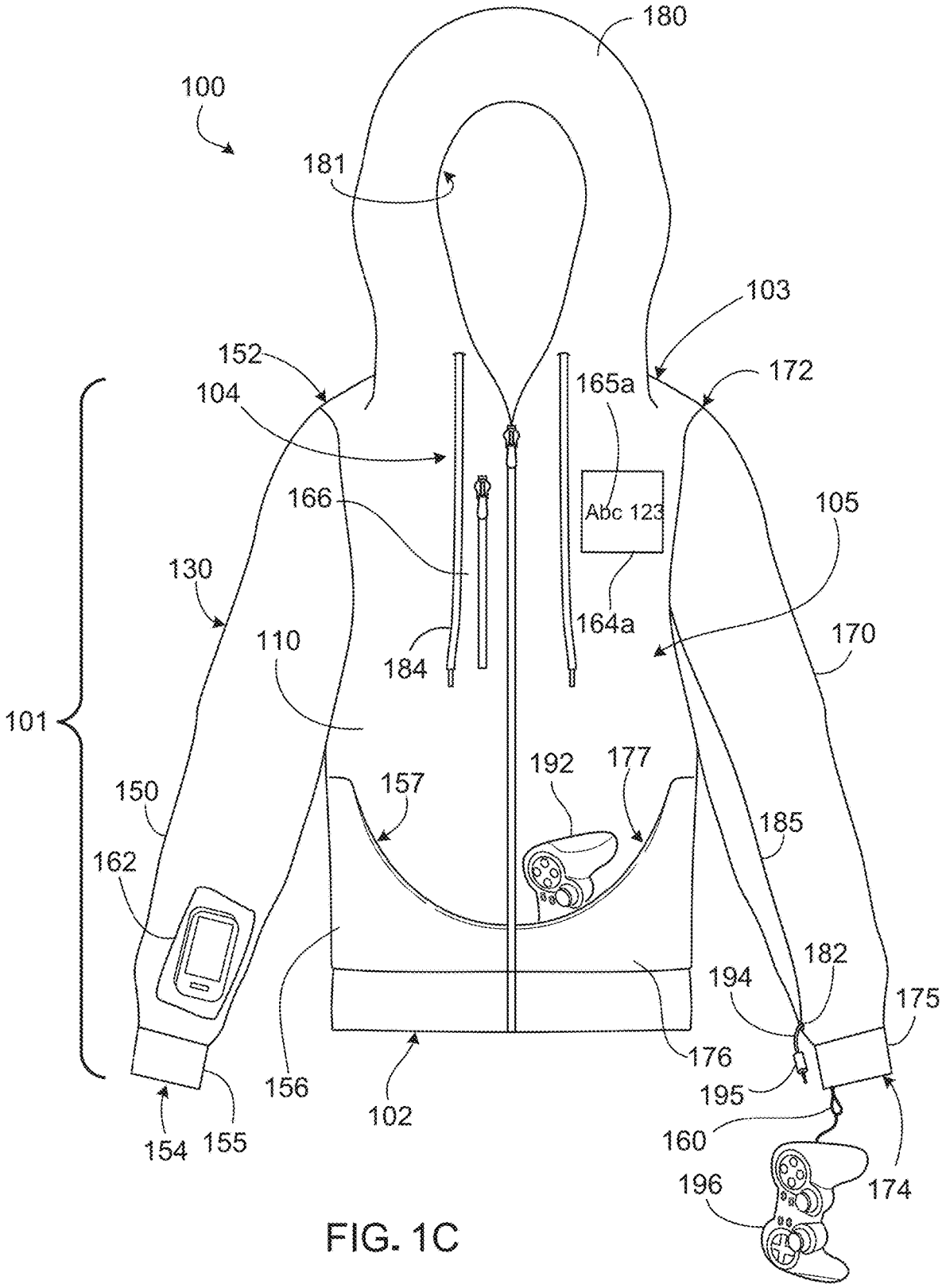

Referring again to FIGS. 1A-8, the left sleeve 170 includes a channel 185 (e.g., a passage for cords). The channel 185 defines a tubular cavity that is configured to retain a section one or more electrical (e.g., wires) or optical (e.g., fiber optic) conductors, such as a cord 194 of the communication headset 190. The channel 185 extends between an opening 181 proximal to the neck region 103, an opening 182 proximal the wrist opening 174 (FIGS. 1A-1C), and an opening 183 proximal an elbow region 178. The garment 100 can include additional openings or alternative opening locations than those presented in FIGS. 1A-8. For example, the garment 100 can include an opening in the garment sleeve near a longitudinal end of the sleeve, at a center-front of the sleeve. The location of the opening(s) 183 can vary. For example, FIG. 2A shows the opening 183 as between an elbow and a wrist area of the left sleeve at a rear side of the sleeve, FIG. 2B shows the opening 183 as proximate to an elbow area of the left sleeve at a rear side of the sleeve, and FIGS. 1A-1C show the opening 182 as proximate to the wrist cuff at an interior side (i.e., closest to wearer's waist) of the sleeve. However, the garment can include one or more openings at any one of the depicted locations or other locations along the sleeve. In addition, the openings can be present on either or both sleeves. In some instances, such as shown in FIGS. 9A-9C on example garments 300, 400, or 500 or in FIG. 13A on example garment 600, an opening 382 (in the form of a slit in the fabric) is located proximate to the wrist cuff of the left sleeve at a front side of the example garment (e.g., in some instances, between the wrist cuff and the electronic device pocket 362). However, the location of this opening 382 can vary. For example, the opening 382 can be located elsewhere on the sleeve, such as proximate to the wrist cuff on a rear side of the sleeve, for example, so as not to position a cable extending through the opening onto a top of the hand of the wearer. The location of the opening(s) can be positioned such that the exit opening is close to the device that a cable is intended to connect to, but also positioned so that any cable is not disrupting the user (e.g., in the way of the user's hand), such as adjacent the wrist cuff on a rear side of the sleeve.

In some embodiments, the channel 185 can be a fold or loop of fabric of the sleeve 170 that is sewn, adhered, or otherwise affixed to the sleeve 170, and the cord 194 can be threaded through the channel 185 from the opening 181 to the opening 182 or the opening 183. For example, the communication headset 190 can come equipped with its own fixed or detachable cord. The wearer can run the cord through the channel 185 so the upper end of the cord 194 exits near the wearer's neck/head, and the other end exits near the wearer's elbow or wrist. In use, the channel 185 can keep the cord 194 out of the wearer's way to prevent the wearer from becoming entangled. In some embodiments, the channel 185 may be open along part of its length. For example, the channel 185 may be made of a collection of loops through which the cord 194 may be passed. In some embodiments, the channel 185 may be openable and recloseable along one or more portions of its length. For example, the channel 185 may include a zipper or hook-and-loop fastener that allows the channel 185 to be opened along at least a portion of its length so the cord 194 may be placed inside and then have the channel 185 be reclosed to retain the cord 194 inside.

In some implementations, the wearer may wish to have the cord 194 exit the opening 182. For example, many console games provide a communications port in a handheld gaming controller, and the opening 182 can provide an exit for the cord 194 that is near the wearer's hand that would be holding the gaming controller. In a different example, PC gaming configurations may provide a communications port on the PC itself and the opening 183 may be used to keep the cord away from the wearer's hands during gameplay.

In some embodiments, the channel 185 may be (or include) a semi-rigid conduit. For example, a tube having an interior with a smooth surface and an inner diameter that is larger than the outer diameter of the cord 194 and/or a plug 195 terminating the cord 194. During assembly, the tube may ease the task of threading the cord 194 through the channel. In use, the tube may provide protection for the cord 194 (e.g., against cutting or abrasion) and/or strain relief (e.g., preventing overly tight bends). In some embodiments, the semi-rigid tube may include a lengthwise split that eases insertion and removal of the cord 194 from the length of the tube.

In some instances, the garment 100 excludes the channel 185 altogether, and the respective openings 182, 183, 382, and/or other are simply slits in the fabric of the sleeve itself. In these instances, a cable extending from a wearer's headset can extend down the interior of the sleeve and exit the sleeve through one of the openings, for example, to connect to a device. In certain examples, the sleeve itself can act as the channel 185, instead of requiring a separate, dedicated channel 185 within the sleeve.

In some examples, the garment 100 can include the cord 194. For example, the garment 100 can be constructed with one or more electrically and/or optically isolated conductors pre-assembled into the sleeve 170, and having a plug or jack at or near the opening 181 and another plug or jack at or near the opening 182 or 183. In use the wearer can plug the communication headset 190 into the built-in cord near the neck region 103, and plug the built-in cord (e.g., directly or indirectly) into a communications port of a gaming controller, console, or PC.

Although the illustrated example shows the channel 185 and the cord 194 in association with the left sleeve 170, in some examples the channel 185 and the cord 194 could be part of the right sleeve 150 instead, or similar channels could be included as part of both of the sleeves 150, 170.

Controller Tether

The left sleeve 170 of the example garment 100 also includes a retainer 160. The retainer 160 is a tether that is configured to be affixed to an electronic game controller 196. In use, the retainer 160 can help keep the controller 196 close to the wearer's hand (e.g., when quickly switching between use of a keyboard and the controller 196). In some embodiments, the retainer 160 can include a hook, clasp, carabineer, clip, tie-able cord, loop of hook-and-loop fastener, or any other appropriate form of apparatus that can releasably retain a gaming controller or other device.

Although the illustrated example shows the retainer 160 in association with the left sleeve 170, in some examples the retainer 160 could be part of the right sleeve 150 instead, or similar retainers could be included as part of both of the sleeves 150, 170.

Electronic Device "Quarterback" Pocket

The example garment 100 includes an electronic device pocket 162 proximal the wrist opening 154 and the expandable cuff 155 of the right sleeve 150. The electronic device pocket 162 is sized and configured to retain an electronic device, such as a smart phone, a small computer tablet, a handheld remote controller, or any other appropriate handheld electronic device.

The electronic device pocket 162 is at least partly made of a substantially transparent material (e.g., flexible plastic film) arranged as a window into the pocket 162, to permit viewing of a display of the electronic device that is retained inside. For example, the electronic device pocket 162 can be used to hold the wearer's smart phone and keep in a location where it is readily visible, similar to the position of a wristwatch or a playbook wristband similar to those worn by American football quarterbacks. In some examples, gamers may have a companion application running on their smart phone (e.g., a map, a team communication link, an inventory list, auxiliary gaming controls) while gaming, and the electronic device pocket 162 can be used to keep their phone in a convenient location on their forearm.

The window of the electronic device pocket 162 is made of a material that is touchscreen compatible, in that the window material permits interaction between a user and a capacitive touchscreen user interface of a device within the electronic device pocket 162. For example, the wearer of the garment 100 may wish to not only view a smart phone or other device within the pocket 162, but also interact with the device (e.g., push onscreen buttons).

Although the illustrated example shows the electronic device pocket 162 being on the right sleeve 150, in some examples the pocket 162 could be part of the left sleeve 170 instead, or similar pockets could be included as part of both of the sleeves 150, 170.

Figure 12:
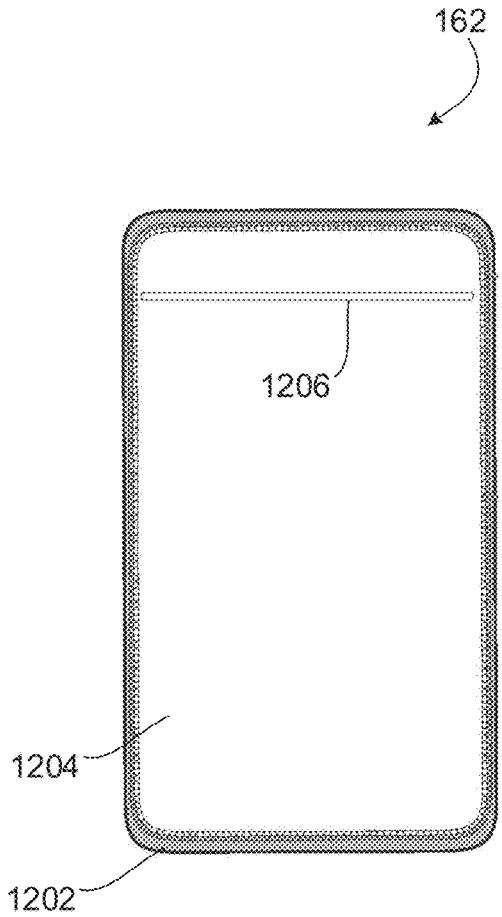
FIG. 12 is a close-up view of an example electronic device pocket that can be used on the example garment of FIGS. 1A-8.

FIG. 12 is a close-up view of the electronic device pocket 162 (or electronic device pocket 362) that can be located on the garment 100 (or garment 300, 400, 500, or 600) on the left sleeve, the right sleeve, or both the left sleeve and the right sleeve. The electronic device pocket 162 includes a bottom fabric layer 1202 that forms a base layer of the pocket 162, and a touch plastic layer 1204 (described above). The bottom fabric layer 1202 and the touch plastic later 1204 are shown as having a substantially rectangular shape with rounded corners; however, the shape of the pocket 162 can vary. The bottom fabric layer 1202 can be a reinforcement layer to reinforce, and provide structure to, the pocket 162. The bottom fabric layer 1202 can be separate from the fabric of the sleeve(s) of the garment 100, or can be formed in (e.g., integral with) the fabric of the sleeve(s) of the garment 100. As described earlier, the touch plastic layer 1204 can include a touch plastic film. The touch plastic layer 1204 is connected to the bottom fabric layer 1202, for example, flat seamed to the bottom fabric layer 1202, along at least a portion of a periphery of the touch plastic layer 1204. In some examples, electronic device pocket 162 is sewn to the garment 100 as an inset at the left sleeve, right sleeve, or both the left sleeve and the right sleeve of the garment 100. The space between the bottom fabric layer and the touch plastic layer define an electronic device pocket chamber of the electronic device pocket 162. The touch plastic layer 1204 is shown in FIG. 12 as including a substantially linear opening 1206 extending laterally across a portion of the touch plastic layer 1204 proximate to an uppermost end of the plastic layer 1204. The touch plastic layer 1204 is flexible, such that the linear opening 1206 can be used to insert or retrieve an electronic device (or other item) from the pocket chamber of the device pocket 162. While FIG. 2 shows the opening 1206 as substantially linear and proximate to the uppermost end of the plastic layer 1204, the shape and location of the opening 1206 can vary.

Patch Pads

The example garment 100 can also include an affixment point 164*a* and an affixment point 164*b*. The affixment points 164*a*, 164*b* provide features that act as attachment points configured to releasably retain additional accessories to the garment 100. In some embodiments, the affixment points 164*a*, 164*b* include fasteners (e.g., hook-and-loop pads, snaps, magnets) that can releasably couple with mating fasteners of accessory items that the wearer can add and remove to/from the garment. In the illustrated example, the affixment points 164*a*, 164*b* are hook-and-loop pads that provide a location to which a removable patch 165*a* and a removable patch 165*b* (e.g., team logos, sponsor messaging, advertisements) are temporarily secured to the garment 100. In other examples, the affixment points 164*a*, 164*b* can be used to temporarily attach auxiliary gaming controllers, electronic devices (e.g., to pin a first-person-view livestream camera onto the wearer), personal items (e.g., hydration tube, personal fan), or any other appropriate accessory. In some embodiments, more or fewer of the affixment points 164*a*, 164*b* can be located at any appropriate location on or inside the garment 100.

In some embodiments, the affixment points 164*a*, 164*b* can provide structure for the removable patches 165*a*, 165*b*. For example (e.g., FIG. 2C), the affixment point 164*b* can include a panel of stiff backing material (e.g., plastic) that can keep the removable patch 165*b* at least semi-erect. In use, such stiffeners can help keep the removable patch 165*b* visible even when the hood 180 is down. In some examples, by keeping the removable patch 165*b* visible, the stiffeners can help enhance identification, publicity, and/or sponsorship value of the removable patch 165*b* for the wearer of the garment 100.

Lapel Pocket

Figure 11:
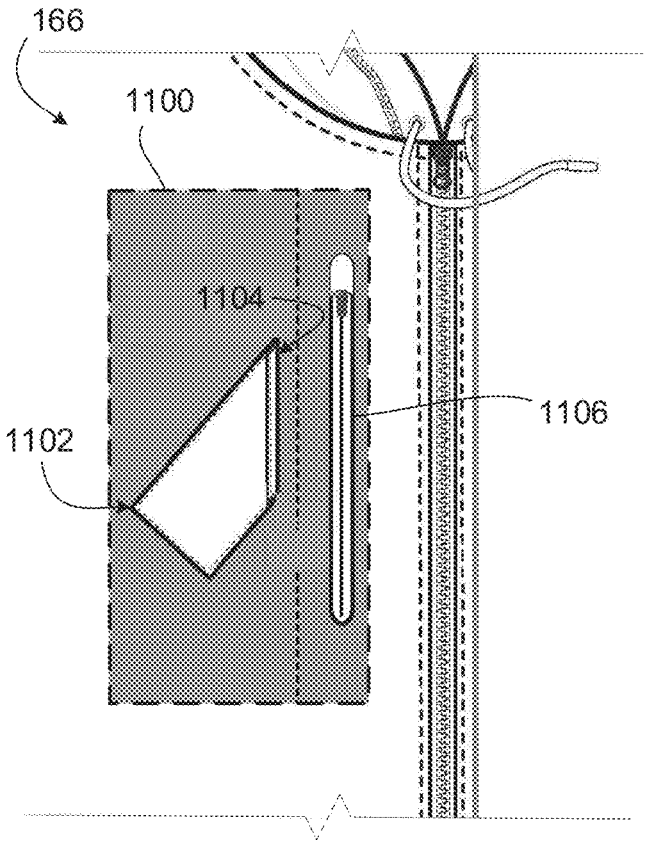
FIG. 11 is a partial front view of an example lapel pocket of the example garment 100 of FIGS. 1A-8.

The example garment 100 also includes a lapel pocket 166. The lapel pocket 166 is provided upon the chest region 110 and includes a fastener (e.g., zipper, hook-and-loop strip, button, or other). The lapel pocket 166 is shown on the front of the garment on the wearer's right side; however, the position of the lapel pocket 166 can be different. For example, the lapel pocket 166 can be positioned on the wearer's left side, and can be oriented vertically, horizontally, slanted, or otherwise oriented on the garment. In use, personal items or other objects may be stowed in the lapel pocket 166 and retained behind the fastener. The lapel pocket 166 includes a pocket chamber or pocket bag that extends from the edge of the lapel pocket (e.g., at the fastener). The pocket chamber can be used to store personal items or other items of the wearer. In some implementations, the lapel pocket 166 includes one or more internal, hidden pockets within the pocket bag of the lapel pocket 166, for example, for specialized storing and securement of items. For example, FIG. 11 is a partial front view of the lapel pocket 166 of the garment 100, where a front, outermost surface of the lapel pocket 166 is transparent. As shown in the example lapel pocket 166 of FIG. 11, the pocket bag 1100 (shown in outline) includes an internal card pocket 1102 with an internal pocket opening 1104 that at least partially faces the pocket edge 1106 (e.g., edge of the lapel pocket 166 at the zipper fastener) of the lapel pocket 166. The internal card pocket 1102 is shaped as a right trapezoid, where the slanted edge of the right trapezoid shape is parallel with (but offset from) the pocket edge 1106. The shape of the internal card pocket 1102 is conducive to holding credit cards, identification cards, or other cards or similar items, and can support these items separate from the larger pocket volume of the lapel pocket 166. Though FIG. 11 shows the internal card pocket 1102 as shaped as a right trapezoid, it can take a different shape. For example, the internal card pocket 1102 can be square, rectangular, trapezoidal, another quadrilateral shape, or a different shape. In some instances, the edge of the internal pocket 1102 at the internal pocket opening 1104 can include an elastic binding finish along its length, for example to reinforce this edge and to better secure items in the internal pocket 1102. The internal pocket 1102 can be formed from a fabric material that is attached to (e.g., sewn on, adhered to, or otherwise secured to) an internal fabric surface of the lapel pocket 166, for example, either the innermost surface (closest to the wearer) or outermost surface (farthest from the wearer) of the lapel pocket 166. In some instances, the internal pocket 1102 is not visible to a viewer of the garment with the lapel pocket 166 fastened closed. Though FIG. 11 shows only one internal card pocket 1102, the lapel pocket 166 can include more than one internal pocket within the pocket bag or pocket chamber of the lapel pocket 166.

In some implementations, any of the example garments described herein can exclude pockets on the rear surface of the example garment. For example, an example garment can exclude one or more of all of the keyboard sheath, a retainer for the keyboard sheath, the rear quick-draw reversed pocket (s), or the rear quick-draw pocket(s). Further, any of the example garments described herein can exclude one or more of the features described, such as one or more or all of the lapel pocket, patch pad(s), electronic device pocket, controller tether, cord keep, front or rear quick-draw reversed pocket(s), front or rear quick-draw pocket(s), keyboard sheath, or hood.

Although a few implementations have been described in detail above, other modifications are possible. For example, other components may be added to, or removed from, the described garments. Accordingly, other embodiments are within the scope of the following claims.

What is claimed is:

1. An upper torso garment, comprising:

a torso section extending from a waist region to a neck region, wherein the torso section comprises a front region and a back region, the front region configured to be positioned adjacent a chest of a wearer of the garment, and the back region configured to be positioned adjacent a back of the wearer, and the torso section comprising a left torso region and a right torso region, the left torso region positioned on a lateral left side of the torso section and the right torso region positioned on a lateral right side of the torso section;

a first reversed pocket positioned on the left lateral side of the front region of the torso section and proximate to the waist region, the first reversed pocket comprising a first pocket opening oriented at least partly toward the right torso region and defining a first pocket chamber, a first side pocket opening on a lateral side of the first reversed pocket and defining a first side pocket chamber separate from the first pocket chamber and the first side pocket opening separate from the first pocket opening, and a first holster pocket opening defining a first holster pocket chamber separate from the first pocket chamber, the first holster pocket opening at least partially overlapping the first pocket opening, wherein the first pocket chamber, first side pocket chamber, and first holster pocket chamber at least partially overlap in a stacked configuration;

a second reversed pocket positioned on the right lateral side of the front region of the torso section and proximate to the waist region, the second reversed pocket comprising a second pocket opening oriented at least partly toward the left torso region and defining a second pocket chamber, a second side pocket opening on a lateral side of the second reversed pocket and defining a second side pocket chamber separate from the second pocket chamber and the second side pocket opening separate from the second pocket opening, and a second holster pocket opening defining a second holster pocket chamber separate from the second pocket chamber, the second holster pocket opening at least partially overlapping the second pocket opening, wherein the second pocket chamber, second side pocket chamber, and second holster pocket chamber at least partially overlap in a stacked configuration;

a right sleeve extending from a right shoulder region of the right torso region and having a first wrist opening; and a left sleeve extending from a left shoulder region of the left torso region and having a second wrist opening.

2. The upper torso garment of claim 1, wherein the first reversed pocket comprises a first, external pocket fabric layer and a second, internal pocket fabric layer, where the space between the first pocket fabric layer and the second pocket fabric layer defines the first holster pocket chamber, and the space between the second pocket fabric layer and a body fabric layer of the torso section defines the first pocket chamber.

3. The upper torso garment of claim 2, wherein the first pocket fabric layer comprises a first peripheral edge defining the first pocket opening to the first pocket chamber; and the second pocket fabric layer comprises a second peripheral edge defining the first holster pocket opening to the first holster pocket chamber, the second peripheral edge being offset from the first peripheral edge.

4. The upper torso garment of claim 1, wherein the second reversed pocket comprises a third, external pocket fabric layer and a fourth, internal pocket fabric layer, where the space between the third pocket fabric layer and the fourth pocket fabric layer defines the second holster pocket chamber, and the space between the fourth pocket fabric layer and a body fabric layer of the torso section defines the second pocket chamber.

5. The upper torso garment of claim 4, wherein the third pocket fabric layer comprises a third peripheral edge defining the second pocket opening to the second pocket chamber; and the fourth pocket fabric layer comprises a fourth peripheral edge defining the second holster pocket opening to the second holster pocket chamber, the fourth peripheral edge being offset from the third peripheral edge.

6. The upper torso garment of claim 1, wherein the torso section comprises at least one of:

a third reversed pocket positioned on the left lateral side of the back region of the torso section and proximate to the waist region, the third reversed pocket comprising a third pocket opening oriented at least partly toward the right torso region; or a fourth reversed pocket positioned on the right lateral side of the back region of the torso section and proximate to the waist region, the fourth reversed pocket comprising a fourth pocket opening oriented at least partly toward the left torso region.

7. The upper torso garment of claim 1, wherein at least one of the right sleeve or the left sleeve further comprises an opening proximal at least one of an elbow region of the right sleeve or the left sleeve.

8. The upper torso garment of claim 1, wherein at least one of the right sleeve or the left sleeve further comprises an opening proximal at least one of the first wrist opening or the second wrist opening, and the opening is positioned at a rear side of the left sleeve or the right sleeve and adjacent to a wrist cuff of the left sleeve or a wrist cuff of the right sleeve.

9. The upper torso garment of claim 1, wherein at least one of the right sleeve or the left sleeve comprises an electronic device pocket positioned proximate to the first wrist opening or the second wrist opening, the electronic device pocket comprising a substantially transparent window configured to permit viewing of a display of an electronic device secured within the electronic device pocket.

10. The upper torso garment of claim 9, wherein the electronic device pocket comprises a bottom fabric layer, a touch plastic layer, and an electronic device pocket chamber defined between the bottom fabric layer and the touch plastic layer, the touch plastic layer connected to the bottom fabric layer along at least a portion of a periphery of the touch plastic layer, the touch plastic layer defining the substantially transparent window.

11. The upper torso garment of claim 10, wherein the bottom fabric layer is connected to or formed integrally in a fabric layer of the at least one of the right sleeve or the left sleeve.

12. The upper torso garment of claim 10, wherein the touch plastic layer comprises an opening through the touch plastic layer configured to allow passage of the electronic device into and out of the electronic device pocket chamber.

13. The upper torso garment of claim 1, further comprising a lapel pocket on the front region of the torso section, the lapel pocket comprising a lapel pocket opening to a lapel pocket chamber.

14. The upper torso garment of claim 13, wherein the lapel pocket comprises an internal card pocket formed entirely within in the lapel pocket chamber.

15. The upper torso garment of claim 1, wherein the garment is formed from fabric comprising spandex, the fabric configured to provide comfort and flexibility to the wearer.

16. The upper torso garment of claim 15, wherein the fabric comprises a combination of fleece and spandex.

17. The upper torso garment of claim 1, wherein the first reversed pocket comprises a zipper to selectively close the first pocket opening, and the second reversed pocket comprises a zipper to selectively close the second pocket opening.

18. An upper torso garment, comprising:

a torso section extending from a waist region to a neck region, wherein the torso section comprises a front region and a back region, the front region configured to be positioned adjacent a chest of a wearer of the garment, and the back region configured to be positioned adjacent a back of the wearer, the torso section comprising a left torso region and a right torso region, the left torso region positioned on a lateral left side of the torso section and the right torso region positioned on a lateral right side of the torso section, the back region comprising a vertical pocket having a pocket opening formed in an upper half of the back region and defining a space having a depth between the neck region and the waist region that is longer than a width between the left torso region and the right torso region;

a first quick-draw pocket positioned on the left lateral side of the front region of the torso section and proximate to the waist region, the first quick-draw pocket comprising a first pocket opening and a first side pocket opening on a lateral side of the first quick-draw pocket and separate from the first pocket opening, the first pocket opening leading to a first pocket chamber, and the first side pocket opening leading to a first side pocket chamber separate from the first pocket chamber, wherein the first pocket chamber at least partially overlaps the first side pocket chamber in a stacked configuration;

a second quick-draw pocket positioned on the right lateral side of the front region of the torso section and proximate to the waist region, the second quick-draw pocket comprising a second pocket opening and a second side pocket opening on a lateral side of the second quick-draw pocket and separate from the second pocket opening, the second pocket opening leading to a second pocket chamber, and the second side pocket opening leading to a second side pocket chamber separate from the second pocket chamber, wherein the second pocket chamber at least partially overlaps the second side pocket chamber in a stacked configuration;

a third reversed pocket positioned on the left lateral side of the back region of the torso section and proximate to the waist region, the third reversed pocket comprising a third pocket opening oriented at least partly toward the right torso region and a first side pocket opening on a lateral side of the third reversed pocket and separate from the third pocket opening; and a fourth reversed pocket positioned on the right lateral side of the back region of the torso section and proximate to the waist region, the fourth reversed pocket comprising a fourth pocket opening oriented at least partly toward the left torso region and a second side pocket opening on a lateral side of the fourth reversed pocket and separate from the fourth pocket opening.

19. The upper torso garment of claim 18, comprising:

a right sleeve extending from a right shoulder region of the right torso region and having a first wrist opening;

a left sleeve extending from a left shoulder region of the left torso region and having a second wrist opening; and an electronic device pocket positioned on at least one of the right sleeve proximate to the first wrist opening or the left sleeve proximate to the second wrist opening, the electronic device pocket comprising a substantially transparent window configured to permit viewing of a display of an electronic device secured within the electronic device pocket.

20. The upper torso garment of claim 19, wherein the electronic device pocket comprises a bottom fabric layer, a touch plastic layer, and an electronic device pocket chamber defined between the bottom fabric layer and the touch plastic layer, the touch plastic layer connected to the bottom fabric layer along at least a portion of a periphery of the touch plastic layer, the touch plastic layer defining the substantially transparent window.

21. The upper torso garment of claim 20, wherein the bottom fabric layer is connected to or formed integrally in a fabric layer of the at least one of the right sleeve or the left sleeve.

22. The upper torso garment of claim 20, wherein the touch plastic layer comprises an opening through the touch plastic layer configured to allow passage of the electronic device into and out of the electronic device pocket chamber.

23. The upper torso garment of claim 18, wherein the vertical pocket is configured to hold at least a portion a personal computer gaming keyboard in a substantially vertical orientation.

24. The upper torso garment of claim 18, wherein the first quick-draw pocket is a first reversed quick-draw pocket where the first pocket opening is oriented at least partly toward the right torso region, and the second quick-draw pocket is a second reversed quick-draw pocket where the second pocket opening is oriented at least partly toward the left torso region.

25. An upper torso garment, comprising:

a torso section extending from a waist region to a neck region, wherein the torso section comprises a front region and a back region, the front region configured to be positioned adjacent a chest of a wearer of the garment, and the back region configured to be positioned adjacent a back of the wearer, and the torso section comprising a left torso region and a right torso region, the left torso region positioned on a lateral left side of the torso section and the right torso region positioned on a lateral right side of the torso section;

a first quick-draw pocket positioned on the left lateral side of the front region of the torso section and proximate to the waist region, the first quick-draw pocket comprising a first pocket opening and a first side pocket opening on a lateral side of the first quick-draw pocket and separate from the first pocket opening, the first pocket opening leading to a first pocket chamber, and the first side pocket opening leading to a first side pocket chamber separate from the first pocket chamber, wherein the first pocket chamber at least partially overlaps the first side pocket chamber in a stacked configuration; and a second quick-draw pocket positioned on the right lateral side of the front region of the torso section and proximate to the waist region, the second quick-draw pocket comprising a second pocket opening and a second side pocket opening on a lateral side of the second quick-draw pocket and separate from the second pocket opening, the second pocket opening leading to a second pocket chamber, and the second side pocket opening leading to a second side pocket chamber separate from the second pocket chamber, wherein the second pocket chamber at least partially overlaps the second side pocket chamber in a stacked configuration.

26. The upper torso garment of claim 25, where the first quick-draw pocket is a first reversed pocket and the first pocket opening is oriented at least partly toward the right torso region, and the second quick-draw pocket is a second reversed pocket and the second pocket opening is oriented at least partly toward the left torso region.

27. The upper torso garment of claim 25, wherein:

the first quick-draw pocket comprises a first holster pocket opening at a longitudinal top of the first quick-draw pocket, the first holster pocket opening leading to a first holster pocket chamber separate from the first pocket chamber and the first side pocket chamber, the first holster pocket chamber at least partially overlaps the first pocket chamber and the first side pocket chamber in the stacked configuration; and the second quick-draw pocket comprises a second holster pocket opening at a longitudinal top of the second quick-draw pocket, the second holster pocket opening leading to a second holster pocket chamber separate from the second pocket chamber and the second side pocket chamber, the second holster pocket chamber at least partially overlaps the second pocket chamber and the second side pocket chamber in the stacked configuration.

28. The upper torso garment of claim 18, wherein:

the first quick-draw pocket comprises a first holster pocket opening at a longitudinal top of the first quick-draw pocket, the first holster pocket opening leading to a first holster pocket chamber separate from the first pocket chamber and the first side pocket chamber, the first holster pocket chamber at least partially overlaps the first pocket chamber and the first side pocket chamber in the stacked configuration; and the second quick-draw pocket comprises a second holster pocket opening at a longitudinal top of the second quick-draw pocket, the second holster pocket opening leading to a second holster pocket chamber separate from the second pocket chamber and the second side pocket chamber, the second holster pocket chamber at least partially overlaps the second pocket chamber and the second side pocket chamber in the stacked configuration.

* * * * *